US007183034B2

(12) United States Patent
Kamada et al.

(10) Patent No.: US 7,183,034 B2
(45) Date of Patent: Feb. 27, 2007

(54) IMAGE FORMING METHOD, IMAGE FORMING APPARATUS AND TONER CARTRIDGE

(75) Inventors: Hiroshi Kamada, Minamiashigara (JP); Masaaki Suwabe, Minamiashigara (JP); Yasuo Kadokura, Minamiashigara (JP); Michio Take, Minamiashigara (JP); Takao Ishiyama, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 273 days.

(21) Appl. No.: 10/659,312

(22) Filed: Sep. 11, 2003

(65) Prior Publication Data

US 2004/0191666 A1 Sep. 30, 2004

(30) Foreign Application Priority Data

Mar. 24, 2003 (JP) ..... 2003-080387

(51) Int. Cl.
*G03G 9/08* (2006.01)

(52) U.S. Cl. ..... 430/120; 430/125; 430/126; 430/110.3; 430/111.4; 430/137.14; 430/45; 399/258; 399/259

(58) Field of Classification Search ..... 430/120, 430/125, 126, 110.3, 111.4, 137.14, 45; 399/258, 399/259

See application file for complete search history.

(56) References Cited

U.S. PATENT DOCUMENTS

| | | | | |
|---|---|---|---|---|
| 5,346,797 | A | 9/1994 | Kmiecik-Lawrynowicz et al. | |
| 5,373,355 | A | 12/1994 | Ando et al. | |
| 6,475,689 | B2 * | 11/2002 | Yamazaki et al. | 430/108.4 |
| 6,617,091 | B2 * | 9/2003 | Nishimori et al. | 430/137.11 |
| 6,746,810 | B2 * | 6/2004 | Suzuki et al. | 430/126 |
| 2004/0053154 | A1 * | 3/2004 | Tomita et al. | 430/109.4 |

FOREIGN PATENT DOCUMENTS

| | | |
|---|---|---|
| JP | A 63-282752 | 11/1988 |
| JP | A 6-35287 | 2/1994 |
| JP | A 6-100195 | 4/1994 |
| JP | A 6-250439 | 9/1994 |
| JP | A 8-234550 | 9/1996 |
| JP | A 10-312089 | 11/1998 |
| JP | A 11-202630 | 7/1999 |

* cited by examiner

*Primary Examiner*—Mark A. Chapman
(74) *Attorney, Agent, or Firm*—Oliff & Berridge, PLC

(57) ABSTRACT

The present invention provides a tandem-type image forming method using a trickle developing system, wherein the average circularity of a toner contained in at least a supplementary developer used for appropriately supplying a developer to a developing device is in the range of 0.940 to 0.980. In the toner, the ratio of the number of particles having an average circularity of 0.970 or greater, in a particle diameter range of a toner circle-equivalent diameter×3/5 or less, is 5% or less, and the ratio of the number of particles having an average circularity of 0.950 or less, in a particle diameter range of a toner circle-equivalent diameter×7/5 or greater, is 10% or less.

18 Claims, No Drawings

IMAGE FORMING METHOD, IMAGE FORMING APPARATUS AND TONER CARTRIDGE

CROSS-REFERENCE TO RELATED APPLICATION

This application claims priority under 35 U.S.C. 119 from Japanese Patent Application No. 2003-80387, the disclosure of which is incorporated by reference herein.

BACKGROUND OF THE INVENTION

1. Field of the Invention

The present invention relates to an image forming method, an image forming apparatus, and a toner cartridge, which are used when forming during formation of an image by developing an electrostatic latent image with a method such as an electrophotographic method or an electrostatic recording method.

2. Description of the Related Art

Formation of an image using an electrophotographic method is performed by developing an electrostatic latent image formed on the surface of a latent image-carrier (i.e., photosensitive member), with a toner containing a colorant. The resulting toner image is transferred onto a transfer receiving material such as paper and fixed with a device such as a thermal roll. The surface of the latent image-carrier is generally cleaned after transfer of the toner image in order to form again an electrostatic latent image.

A dry developer used in such the electrophotographic method is roughly classified into a one-component developer which uses a toner obtained by incorporating a colorant and the like into a binding resin alone, and a two-component developer obtained by mixing a carrier into a toner. The one-component developer can be classified into a magnetic one-component developer which uses a magnetic powder, and is conveyed by a developer-carrier with a magnetic force, followed by developing, and a non-magnetic one-component developer which does not use a magnetic powder, and is conveyed by a developer-carrier with electrification impartment, followed by developing.

Since the late 1980s, in the market of electrophotography, miniaturization and high functionalization have been strongly demanded targeting digitalization and, in particular, regarding the full color image quality, high grade printing, and high image quality class near that of a silver halide photography are desired. As means for attaining the high image quality, digitalization treatment is essential. As the efficacy of digitalization regarding such the image quality, there is complex image treatment at a high speed. For that reason, in a digital format, it becomes possible to control letter images and photography images separately, and the reproductivity of letter images and photography images has been greatly improved as compared with an analog format. In particular, regarding a photography image, since gradation correction and color collection have become possible, a digital format is advantageous in the gradation property, the fineness, the sharpness, the color reproductivity and the granularity as compared with an analog format.

Upon image formation, it is necessary to faithfully reproduce a latent image produced by an optical system as an image. For this reason, for the purpose of faithfully reproducing an image, research and exploitation for making a particle diameter of a toner smaller are being performed more actively. However, only by merely making a particle diameter of a toner smaller, it is difficult to stably achieve a high quality image, and improvement in fundamental property regarding development, transfer and fixation has become more important.

When a color image is obtained, generally, three color or four color toners are overlaid to form an image. For that reason, when any of these color toners exhibits the different property from the initial property or the different performance from that of other color from a viewpoint of development, transfer and fixation, reduction in the color reproductivity, deterioration in the granularity, and deterioration in the image quality such as uneven color are caused. In order to maintain an initial high quality image stably and for a long term, how the property of each color toner is stably controlled, is important.

In recent years, from a viewpoint of speeding up when a color image is obtained (referred to simply as "color speeding up" in some cases), a so-called tandem developing system-type image forming apparatus using a plurality of developing units composed of a developing device containing a developer-carrier, a latent image-carrier and the like, is adopted. In the tandem developing system, from a viewpoint of complying to space saving and miniaturization of an image forming apparatus, a small diameter of a latent image-carrier in each developing unit is sought. Regarding such the tandem developing system, many studies have been made (e.g. Japanese Patent Application Laid-Open (JP-A) Nos. 6-35287 and 6-100195).

By adopting such the tandem developing system, color speeding up becomes easier as compared with the rotary developing system. However, in the tandem development system, even when a single color image such as black is formed, it is general that other color developer-carriers are also in contact with a latent image-carrier and, at the same time, are forced to rotate in a process direction.

In such the case, since a stress received by a developer is large, and reduction in the electrifiability of a developer is induced, reduction in the developing performance and reduction in the transferring performance are easily caused, and finally, leading to deterioration in the image quality. In addition, in the tandem developing system, since a size of one developing device is limited due to limitation of a space around a latent image-carrier, or a size of an apparatus, a sufficient amount of a developer can not be stored in each developing device. Therefore, a stress received by a developer is liable to be greater due to a structure of such the apparatus. For that reason, exchange of a developer is frequently performed with deterioration in a developer, and this leads to remarkable increase in the service cost.

As means for suppressing deterioration of a developer, JP-A No. 8-234550 proposes the technique using several kinds of supplementary developers containing carriers having the different physical properties. However, in this technique, since variation in the physical property of a carrier has influence on the toner flowability, the properties between toner colors and the like, control system becomes complex, leading to scaling up or increase in the cost of an apparatus.

In addition, JP-A No. 11-202636 proposes the technique of supplementing a supplementary developer containing a carrier having a larger amount of electricity than that of a carrier used in a starting developer. This technique is very advantageous in prolonging a life of a developer. On the other hand, when the image stability is taken into consideration, it is important that the physical property of a developer does not change by the environment and continuous use, but this technique controls the physical property of a developer microscopically with difficulty.

As a developer, a two-component-developer composed of a toner and a carrier, and a one-component developer using a magnetic toner or a non-magnetic toner alone is known. For preparing the toner, a kneading and grinding process is usually utilized in which a thermoplastic resin is melted and kneaded together with a pigment, a charge control agent, a releasing agent such as a wax, which is cooled, and finely-divided and classified. If needed, in order to improve the flowability and the cleanability, a fine particle composed of an inorganic material or an organic material is added to the surface of the toner in some cases. A toner prepared by utilizing these processes for preparing a toner has the most excellent property, but has some problems as described below.

For example, when a toner is prepared by a kneading and grinding process, a shape and a surface structure of the resulting toner are undefined. In addition, although a shape and a surface structure of a toner are subtlety changed depending on the grindability of a material used as a raw material and the conditions of a grinding step, it is difficult to intentionally control a shape and a surface structure of a toner. In addition, in a kneading and grinding process, there is a limitation on a range of material selection. Specifically, a dispersion of a colorant in a resin in which a colorant is dispersed in a resin must be sufficiently brittle and can be finely-divided with an economically available preparing apparatus. However, when a dispersion of a colorant in a resin is made to be brittle in order to satisfy such the request, a fine powder is produced by a mechanical shearing force applied to a toner in a developing device, and a toner shape is changed in some cases.

Due to these influences, in a two-component developer, deterioration in electrification of a developer due to adhering of a fine powder to the carrier surface is accelerated and, in a one-component developer, scattering of a toner is caused due to expansion of a particle size distribution, and deterioration in the image quality is easily caused due to reduction in the developability by a change in a toner shape.

In addition, when a toner is prepared by internally adding a large amount of a releasing agent such as a wax, a releasing agent is remarkably exposed on the toner surface depending on a combination of a thermoplastic resin and a releasing agent. In particular, in a combination of a resin, which has the increased elasticity due to a high-molecular component and is slightly ground with difficulty and a brittle wax such as polyethylene, exposure of polyethylene on the toner surface is observed frequently. Such the exposure of a releasing agent on the toner surface is advantageous in the releasability at fixation and cleaning of an untransferred toner remaining on the surface of a photosensitive member. However, since a releasing agent exposed on the toner surface is easily transferred to another member by a mechanical force, contamination of a developing roll, a photosensitive member and a carrier is easily caused, leaving to reduction in reliance.

Further, when a toner shape is undefined, even if a flowing assistant is added, the sufficient flowability is not retained in some cases. In such the case, a fine particle present on the toner surface is transferred to a recess part on the toner surface by a mechanical shearing force applied to a toner at image formation, whereby, the flowability of a toner is reduced with time, and a flowing assistant is embedded in the interior of a toner, whereby, the developability, the transferability and the cleanability are deteriorated. In addition, when a toner collected by cleaning is returned again to a developing device, and is used, deterioration in the image quality is further easily caused. When an amount of a flowing assistant to be added to a toner is further increased, a black point is produced on the surface of a photosensitive member, and scattering of a flowing assistant particle is caused.

In recent years, as means that allows for intentional control of a shape and a surface structure of a toner, JP-A Nos. 63-282752 and 6-250439 propose a process for preparing a toner by a polymerization aggregating method. This process for preparing a toner is generally a process for preparing a toner by mixing a resin fine particle dispersion prepared by emulsion polymerization and a colorant dispersion prepared by dispersing a colorant in a solvent, to form an aggregate having a diameter equivalent to a toner particle diameter, then, heating this aggregate to melt and coalescing it. The toner obtained by this process is not only easy in downsizing a diameter of a toner, but also extremely excellent in a particle size distribution.

In more recent years, a demand on the higher image quality is increased and, in particular, in color image formation, in order to achieve a highly fine image, there is a remarkable tendency that a toner to be used is downsized. However, when a toner is simply downsized while maintaining the previous particle size distribution, since toners on a smaller diameter side of the particle size distribution are present, contamination of a carrier and a photosensitive member and scattering of a toner increases remarkably, and it is difficult to achieve the high image quality and the high reliance at the same time. For that reason, a toner having a sharp particle size distribution and a small particle diameter is necessary. From a viewpoint that such the toner can be obtained, an emulsion polymerization aggregation method is advantageous as a process for preparing a toner.

In addition, recently, from a viewpoint of conversion into a digital machine and improvement in the productivity of office documents, when speeding up and energy saving are taken into consideration, a toner is also required to have the fixability at a lower temperature. Also from these points, a toner having a sharp particle size distribution and which is prepared by an aggregating and coalescing method suitable for preparing a toner has the excellent property.

In addition, a method of covering the surface of a fixing member such as a fixing roll with a fluorine series resin film such as polytetrafluoroethylene for the purpose of reducing the wettability between a developed and transferred toner and a material such as a paper, and maintaining a peelability can be utilized as one means for attaining the aforementioned energy saving. However, since this fluorine series resin film inhibits conduction of thermal energy supplied to a fixing roll in some cases, a thickness of the film is limited. In addition, when a thickness of the fluorine series resin film is decreased for the purpose of making influence on thermal conduction small, the durability of a fixing member is deteriorated in some cases due to remarkable occurrence of crease on the surface of a fixing member. For this reason, there is desired exploitation of a toner, which is not necessary to cover the surface of a fixing member such as a fixing roll with a fluorine series resin film.

Further, variation in a toner shape, and a particle diameter and the flowability of a toner produces variation in electrification of a toner, and the insulating property of a toner has influence on the electrification maintaining property. Such the variation in the physical property of a toner leads to occurrence of phenomenon (so-called selective developing phenomenon) in which a toner having the better electrifiability is selectively consumed upon image formation, a toner having the low electrifiability remains in a developing device, and deterioration in the developability is caused as a whole developer.

When deterioration of a developer is accelerated due to selective developing, it becomes necessary to exchange a developer, leading to remarkable increase in the service cost. In particular, in the tandem developing system, since a sufficient amount of a developer can not be stored in each developing device from a viewpoint of a space, deterioration of a developer is easily accelerated due to variation in the electrifiability of a toner and, thus, there is desired improvement in the maintenance of a developer also from a viewpoint of a toner.

In addition, JP-A No. 10-312089 reports that, by stirring a toner in a developing device, a microstructure of the toner surface is easily changed, and the transferability is greatly changed. By a change in a microstructure of the toner surface, variation in the electrifiability of a toner easily becomes large, resulting in promotion of selective developing, and reduction in maintenance of a developer becomes more remarkably problematic.

SUMMARY OF THE INVENTION

An object of the present invention is to solve the aforementioned problems. That is, an object of the invention is to provide an image forming method, an image forming apparatus and a toner cartridge, in which deterioration with time in the electifiability, the developability, the transferability and the fixability is hardly caused and, even when image formation is performed for a longer period of time, an image of the high image quality can be formed stably, in tandem-type image formation utilizing so-called trickle development having two or more image forming processes and performing image formation while supplying a developer to a developing device used in at least one image forming process and collecting an excessive developer in the developing device.

The present inventors intensively studied in order to attain the aforementioned object. As a result, the present inventors confirmed that the previous tandem-type image formation utilizing trickle development can generally form an image of the stable image quality as compared with tandem-type image formation not utilizing trickle development even when image formation is performed for a long period of time, but deterioration in the image quality is easily caused in a relatively short time in some cases, depending on a kind of a toner used in image formation.

The present inventors paid their attention to this point, and found that it is effective to use at least a toner having a specific shape and a shape distribution as a supplementary developer, which resulted in completion of the invention. That is, the invention is as follows:

An aspect of an image forming method of the invention is an image forming method, which comprises: two or more toner image forming processes comprising at least an electrifying step of electrifying the surface of a latent image-carrier; a latent image forming step of forming a latent image on the surface of the electrified latent image-carrier; and a developing step of forming a toner image by developing the latent image formed on the surface of the latent image-carrier with an electrostatic image developer, which is stored in a developing device and contains a toner and a carrier, wherein in at least one of the two or more toner image forming processes, the developing step is performed while appropriately supplying a supplementary developer containing a toner and a carrier to a developing device, and collecting excess electrostatic image developer that appears in the developing device due to the supplying of the supplementary developer, and an image is formed on a transfer receiving material via at least a toner image overlaying step of successively overlaying a toner image formed by each of the two or more toner image forming processes, and an average circularity of a toner contained in at least the supplementary developer is in the range of 0.940 to 0.980; a ratio of the number of particles having an average circularity of 0.970 or greater, in a particle diameter range of a toner circle-equivalent diameter×3/5 or less, is 5% or less; and a ratio of the number of particles having an average circularity of 0.950 or less, in a particle diameter range of a toner circle-equivalent diameter×7/5 or greater, is 10% or less.

An aspect of an image forming apparatus of the invention is an image forming apparatus, which comprises at least: two or more developing units provided with at least a latent image-carrier, an electrifying means for electrifying the surface of the latent image-carrier, latent image forming means for forming a latent image on the surface of the electrified latent image-carrier, and a developing device for storing an electrostatic image developer containing a toner and a carrier, wherein the developing device develops the latent image formed on the surface of the latent image-carrier with the electrostatic image developer, so as to form a toner image; and a toner image overlaying means for successively overlaying a toner image, which is formed by each of the two or more developing units, onto a transfer receiving material, wherein at least one of the two or more developing units is provided with at least a developer supplying means for appropriately supplying a supplementary developer containing a toner and a carrier to a developing device, and a developer collecting means for collecting excess electrostatic image developer that appears in the developing device due to the supplying of the supplementary developer, and an average circularity of a toner contained in at least the supplementary developer is in the range of 0.940 to 0.980; a ratio of the number of particles having an average circularity of 0.970 or greater, in a particle diameter range of a toner circle-equivalent diameter×3/5 or less, is 5% or less; and a ratio of the number of the particles having an average circularity of 0.950 or less, in a particle diameter range of a toner circle-equivalent diameter×7/5 or greater, is 10% or less.

A first aspect of a toner cartridge of the invention is a toner cartridge that is detachable from an image forming apparatus and which stores a supplementary developer containing a toner in which an average circularity is in the range of 0.940 to 0.980; a ratio of the number of particles having an average circularity of 0.970 or greater, in a particle diameter range of a toner circle-equivalent diameter×3/5 or less, is 5% or less; and a ratio of the number of particles having an average circularity of 0.950 or less, in a particle diameter range of a toner circle-equivalent diameter×7/5 or greater, is 10% or less.

A second aspect of a toner cartridge of the invention is a toner cartridge used in an image forming apparatus, comprising at least: two or more developing units provided with at least a latent image-carrier, an electrifying means for electrifying the surface of the latent image-carrier, latent image forming means for forming a latent image on the surface of the electrified latent image-carrier, and a developing device for storing an electrostatic image developer containing a toner and a carrier, wherein the developing device develops the latent image formed on the surface of the latent image-carrier with the electrostatic image developer, so as to form a toner image; and a toner image overlaying means for successively overlaying a toner image, which is formed by each of the two or more developing units, onto a transfer receiving material, wherein at least one of the two or more developing units is provided with at least a toner cartridge for storing a supplementary developer containing a toner and a carrier, and appropriately supplying the supplementary developer to a developing device; and a developer collecting means for collecting excess electrostatic image developer that appears in the developing device due to the supplying of the supplementary developer, and an average circularity of a toner contained in a supplementary developer stored in the toner cartridge is in the range of 0.940 to 0.980; a ratio of the number of particles having an average circularity of 0.970 or greater, in a particle diameter range of a toner circle-equivalent diameter×3/5 or less, is 5% or less; and a ratio of the number of particles having an average circularity of 0.950 or less, in a particle diameter range of a toner circle-equivalent diameter×7/5 or greater, is 10% or less.

DETAILED DESCRIPTION OF THE INVENTION

The present invention is roughly divided into an image forming method of the invention, an image forming apparatus of the invention, and a toner cartridge of the invention, and will be described in this order below.

<Image Forming Method>

An image forming method of the invention is an image forming method (tandem-type image forming method utilizing so-called trickle development), which comprises: two or more toner image forming processes comprising at least an electrifying step of electrifying the surface of a latent image-carrier; a latent image forming step of forming a latent image on the surface of the electrified latent image-carrier; and a developing step of forming a toner image by developing the latent image formed on the surface of the latent image-carrier with an electrostatic image developer, which is stored in a developing device and contains a toner and a carrier, wherein in at least one of the two or more toner image forming processes, the developing step is performed while appropriately supplying a supplementary developer containing a toner and a carrier to a developing device, and collecting excess electrostatic image developer that appears in the developing device due to the supplying of the supplementary developer, and an image is formed on a transfer receiving material via at least a toner image overlaying step of successively overlaying a toner image formed by each of the two or more toner image forming processes, and (1) an average circularity of a toner contained in at least the supplementary developer is in the range of 0.940 to 0.980; (2) a ratio of the number of particles having an average circularity of 0.970 or greater, in a particle diameter range of a toner circle-equivalent diameter×3/5 or less, is 5% or less; and (3) a ratio of the number of particles having an average circularity of 0.950 or less, in a particle diameter range of a toner circle-equivalent diameter×7/5 or greater, is 10% or less.

Therefore, according to the image forming method of the invention, deterioration in the electrifiability, the developability, the transferability and the fixability with time is hardly caused and, even when image formation is performed for a longer period of time, an image of the high image quality can be stably formed as compared with the previous tandem-type image forming method utilizing trickle development.

Such the effect can be attained by a combination of a toner having a shape and a shape distribution shown in the above (1) to (3) items, and a trickle developing process.

First, a toner having the aforementioned shape and shape distribution used in the image forming method of the invention suppresses variation in the electrifiability, hardly causes disadvantage due to selective developing, improves the maintenance of a developer and, even when used for a long term, hardly causes change in a microstructure on the toner surface by various stresses, and does not promote selective developing.

Further, by combining a toner having the shape and shape distribution shown in the above (1) to (3) items with a trickle developing process, deterioration of a toner used at image formation with time is suppressed over a long term. That is, the sharp electrifying property can be maintained for a long term, impaction can be suppressed over a long term, supply of a toner to a developing device is stably performed over a long term due to stabilization of the flowability of a toner, thereby, even when image formation is performed for a long term, an image of the high image quality can be formed stably.

A toner used in the image forming method of the invention is not particularly limited as far as its shape and shape distribution meet the shape and shape distribution shown in the above (1) to (3) items, but specifically, the following is preferable.

Therefore, (1) an average circularity is necessary to be in the range of 0.940 to 0.980, preferably in the range of 0.945 to 0.975, more preferably in the range of 0.955 to 0.970.

When an average circularity is less than 0.94, a toner shape becomes undefined and a toner is ground by a carrier. On the other hand, when an average circularity exceeds 0.980, a toner shape becomes substantially true sphere-like, whereby, the flowability becomes too better, scattering of a toner is caused, and it becomes difficult to clean such the toner which remains in a latent image-carrier upon image formation.

In addition, (2) a ratio of the number of particles having an average circularity of 0.970 or greater, in a particle diameter range of a toner circle-equivalent diameter×3/5 or less, is necessary to be 5% or less, preferably 3% or less.

When a ratio of the number of particles having an average circularity of 0.970 or greater, in a particle diameter range of a toner circle-equivalent diameter×3/5 or less, exceeds 5%, toner scattering and worse cleaning on a latent image carrier become remarkable. In the previous toner, a ratio of the number of particles having an average circularity of 0.970 or greater, in a particle diameter range of a toner circle-equivalent diameter×3/5 or less, was usually in the range of 10 to 20%.

Further, (3) a ratio of the number of particles having an average circularity of 0.950 or less, in a particle diameter range of a toner circle-equivalent diameter×7/5 or greater, is necessary to be 10% or less, preferably 5% or less.

When a ratio of the number of particles having an average circularity of 0.950 or less, in a particle diameter range of a toner circle-equivalent diameter×7/5 or greater, exceeds 10%, the flowability of a developer becomes worse, spots are produced upon developing and, even on an image, concentration spots at a solid part and reduction in the image concentration occur. In the previous toner, a ratio of the number of particles having an average circularity of 0.950 or less, in a particle diameter range of a toner circle-equivalent diameter×7/5 or greater, was in the range of 15 to 20%.

Note that, an average circularity of a toner can be achieved by extracting via suction toners to be measured, instantaneously capturing a configuration of a toner particle in the state where the particle is dispersed so as to form a very flat stream, as a stationary image, utilizing strobe emission, and analyzing the obtained stationary image of a toner particle with an image analyzing apparatus FPIA-2100 (manufactured by Sysmex Corporation). Note that, a sampling number of toner particles when an average circularity is obtained, is 3500. In addition, an average circularity is obtained according to (length of circumference of circle having the same projected area as that of particle image)/(length of circumference of particle projected image) and, in the case of a true sphere, a toner circularity becomes 1 and, as a value grows smaller, a shape becomes undefined, going away from a true sphere.

In the image forming method of the invention, a toner having the shape and shape distribution shown in the above (1) to (3) items (hereinafter, abbreviated as "toner used in the invention") is enough to be contained in at least a supplementary developer.

When a toner contained in a supplementary developer is a toner not having the shape and the shape distribution shown in the above (1) to (3) items, an image of the high image quality can not be formed stably when image formation is performed for a longer term, as compared with the previous tandem-type image forming method utilizing trickle development.

In addition, when an unused developer (hereinafter, in the invention, referred to as "starting developer" in some cases) is stored in a developing device, it is preferable that a toner contained in this unused developer is also a toner having the shape and shape distribution shown in the above (1) to (3) items.

When a toner contained in an unused developer does not have the shape and shape distribution shown in the above (1) to (3) items, image formation is performed by using mainly a toner not having the shape and shape distribution shown in the above (1) to (3) items until an unused developer prestored in the developing device is mostly replaced with a supplementary developer. In this case, until a toner is sufficiently replaced, even when image formation is performed, an image of the high image quality can not be stably formed transiently.

In the invention, when a starting developer and a supplementary developer contain a toner having the shape and shape distribution shown in the above (1) to (3) items, both are fundamentally the same developer except that a blending ratio of a toner and a carrier is different.

[Toner]

Then, preferable properties other than the shape and shape distribution shown in the above (1) to (3) items of a toner used in the invention will be described in detail below.

A volume average particle diameter of a toner used in the invention is preferably in the range of 3 to 10 μm, a volume average particle size distribution index GSD (V) is preferably 1.25 or less, a number average particle size distribution index GSD (p) is preferably 1.25 or less, and a lower side number average particle size distribution index GSD (punder) is preferably 1.27 or less.

By rendering a volume average particle diameter and a particle size distribution of the toner in the above range, a highly fine image can be achieved and, at the same time, the powder flowability, the electrification stability, the transferability and the like become excellent. In particular, from a viewpoint of the high image quality, it is preferable that a volume average particle diameter of the toner is in the range of 3 to 6 μm. In addition, a particle size distribution can be measured with a Coulter Multisizer II (manufactured by Nikkaki-bios Corporation).

In addition, it is preferable that a dielectric constant $\epsilon'$ of a toner used in the invention is in the range of 1.0 to 2.7, and a dielectric loss tangent tan $\delta$ of the toner is a range of 0.002 to 0.018.

By rendering the dielectric property in the above range like this, an electrification amount of an individual toner becomes uniform, and the maintenance thereof is improved. In addition, since the electrifiability is continued, even when transfer is repeated plural times, the high image quality is maintained over a longer period of time, and the excellent image reproductibity is achieved.

Here, a dielectric constant $\epsilon'$ and a dielectric loss tangent tan $\delta$ are measured with MUTI-FREQUENCY LCR METER (manufactured by Hewlett Packard, Ltd.).

Specifically, a dielectric constant $\epsilon'$ and a dielectric tangent tan $\delta$ are obtained by measuring a sample on an electrode for measuring a dielectric material, under the condition of a frequency of 1 kHz by a method described in JIS K6911. Here, the sample for the measuring is 5 g of toner placed into a mold having a diameter of 5 cm and loaded a weight of 10 ton for 1 minute to mold.

In addition, in a toner used in the invention, it is preferable that at least fine inorganic particles are added to at least the surface of a toner contained in the supplementary developer, a flowability index (compression ratio) G1 of the toner having fine inorganic particles added to the surface thereof is in the range of 0.32 to 0.45, and a ratio of the flowability index (compression ratio) G1 relative to a flowability index (compression ratio) G2 (G1/G2) after the toner having fine inorganic particles is mixed with fine magnetic metal particles, the surfaces of which are covered with an organic layer, and the mixture is stirred at an angular frequency of 30 rad/s or more for 60 minutes, is 0.63 or more.

When a flowability index G1 of the toner having fine inorganic particles added to the surface thereof is smaller than 0.32, the compressibility is high, mutual toners cause packing, and the toner conveyability in a developing device is deteriorated in some cases. On the other hand, when G1 is greater than 0.45, since the flowability is reduced in some cases, toner fineness is reduced in some cases upon output of an image.

In addition, a ratio of the flowability index (compression ratio) G1 relative to a flowability index (compression ratio) G2 (G1/G2) after the toner having fine inorganic particles is mixed with fine magnetic metal particles, the surfaces of which are covered with an organic layer, and the mixture is stirred at an angular frequency of 30 rad/s or more for 60 minutes, is smaller than 0.63, the flowability of a toner subjected to such the treatment is changed at image formation in some cases. Such the change in the flowability deteriorates the toner conveyability and the transferability in a developing device, leading to deterioration of the image quality in some cases. In addition, the aforementioned angular frequency value is a suitable rate for deteriorating a toner having fine inorganic particles added to the surface thereof which has been mixed with fine magnetic metal particles having the surface covered with an organic layer.

In the image forming method of the invention, usually, it is preferable that the above-described toner having fine inorganic particles added to the surface thereof is used as a toner for a supplementary developer and a starting developer. Note that, in general, addition of fine inorganic particles to the toner surface is performed in order to further improve and stabilize the electrifiability and the flowability of a toner itself.

However, the fine inorganic particle is influenced by a hardness and a surface shape of a toner itself, and is deteriorated to an extent by embedding in the toner surface and detachment due to scattering of fine inorganic particles at image formation in some cases, and the toner properties such as the electrifiability, and the flowability get close to the properties of a toner with no fine inorganic particle attached thereto, with time, in some cases.

By meeting of the aforementioned range by a ratio of a flowability index G1 and a flowability index G2 (G1/G2) of a toner having fine inorganic particles added to the surface thereof used in the invention, the powder flowability of a toner can be rendered more uniform. For this reason, variation in conveyance and the electrifiability and this advantage due to selective developing are alleviated and the maintenance of a developer is further improved. Further, in the aforementioned range, disturbance of an image due to overflow (too better flowability of a toner) can be suppressed, and a stable image of the high image quality can be achieved in this point.

Note that, a flowability index (compression ratio) is measured using a powder tester (manufactured by Hosokawamicron Corporation). Letting a loose apparent specific gravity to be X and a hard apparent density to be Y, a compression ratio G is obtained from compression ratio G=(Y−X)/Y.

In addition, in a toner used in the invention, it is preferable that an exposure rate of a releasing agent on the toner surface quantified by X-ray photoelectron spectrometry (XPS) is in the range of 11 to 40 atm %.

When an exposure rate of a releasing agent on the toner surface is smaller than 11 atm %, if an image is continuously formed, the fixability is deteriorated in the long run in some cases, although the fixability has no influence at an early stage. When the fixability is deteriorated, offset occurs at a high fixation temperature and, when a fixation temperature is low, reduction in the strength of the fixed image is caused in some cases.

On the other hand, when the exposure rate exceeds 40 atm %, it has no influence on the fixability, but filming on a carrier, a developing roll, a photosensitive member and an electrification roll occurs in some cases. In addition, there easily occurs in some cases phenomenon in which an external additive added to the toner surface for imparting the flowability is embedded in the interior of a toner.

Note that, an exposure rate of a releasing agent on the toner surface can be measured by separating peaks resulting from a resin, a pigment and a wax component present on a toner surface, and peaks resulting from a releasing agent, and quantified the latter, using X-ray photoelectron spectrometer (XPS: manufactured by JEOL., Ltd.).

[Process for Preparing Toner]

A process for preparing a toner used in the invention is not particularly limited, but a wet process is desirable. Examples of a wet process include an aggregating and coalescing method, a dissolution suspension granulating method and the like.

When an aggregating and coalescing method is utilized as a process for preparing a toner, a resin particle constituting a resin component of a toner is generally prepared by emulsion polymerization. It is preferable that such the aggregating and coalescing method comprises the following steps, specifically.

That is, a method comprising a first aggregating step of adding an aggregating agent to a mixture, which is obtained by mixing a first resin fine particle dispersion, in which first resin fine particles having an average particle diameter of 1 μm or less are dispersed, a colorant dispersion, a releasing agent dispersion, and a dispersion in which fine inorganic particles are dispersed, so as to form core aggregated particles in the mixture; a second aggregating step of forming a surface layer containing second resin fine particles on the surface of the core aggregated particles using a second resin fine particle dispersion in which the second resin fine particles are dispersed, to prepare core/shell-type aggregated particles; and a fusing and coalescing step of fusing and coalescing the core/shell-type aggregated particles by heating the core/shell-type aggregated particles to a temperature higher than the glass transition temperatures of the first resin fine particles and the second resin fine particles.

Here, as a resin fine particle dispersion, for example, a resin fine particle dispersion can be used in which resin particles are dispersed with an ionic surfactant. In addition, as a colorant dispersion and a releasing agent dispersion, a dispersion can be used in which a colorant or a releasing agent is dispersed with an ionic surfactant having the reverse polarity to that of the ionic surfactant contained in the resin fine particle dispersion.

After a fusing and coalescing step, the conventional washing and drying can afford a toner.

In the aforementioned method, each step can be specifically performed as follows:

In a first aggregating step, balance between amounts of ionic surfactants having the respective polarity contained in each dispersion can be shifted in advance. Then, inorganic metal salts such as calcium nitrate, or a polymer of inorganic metal salt such as polyaluminum chloride are added to a mixture obtained by mixing respective dispersions, to ionically neutralize an ionic surfactant contained in the mixture. Thereafter, the mixture is heated at a lower temperature than a glass transition point to form core aggregated particles.

After the first aggregating step is completed, a second aggregating step is performed. In a second aggregating step, a second resin particle dispersion in which an ionic surfactant having such the polarity that compensates for a shift of balance in ions in the mixture after completion of the first aggregating step, is added to the mixture. In this state, the mixture is slightly heated at a glass transition point or lower of a resin contained in the core aggregated particles or the second resin particle dispersion as necessary, to form core/shell type aggregated particles.

After the second aggregating step is completed, a fusing and coalescing step is performed. In the fusing and coalescing step, the core/shell type aggregated particles is fused and coalesced by heating the mixture after completion of the second aggregating step to a glass transition point or higher.

Note that, the first aggregating step and the second aggregating step may be each repeated plural times.

In addition, as an aggregating agent used in the first and/or second aggregating step, a compound containing a metal can be used, and it is particularly preferable that the compound is an aluminum compound containing aluminum ions. An aluminum compound which dissolves in a mixture prepared at each aggregating step may be used, and examples thereof include metal salts such as aluminum chloride, and aluminum sulfate, and inorganic metal polymers such as polyaluminum chloride and polyaluminum hydroxide.

Generally, in order to render a particle size distribution of a toner sharp, it is preferable that a valent number of a metal contained in an aggregating agent is divalent rather than monovalent, or trivalent or greater rather than divalent. Further, in the case where divalent numbers of metals are the same, as a compound containing a metal utilized as an aggregating agent, an inorganic metal salt polymer synthesized by polymerization is better.

The amount of the aluminum compound to be added to the mixture is preferably in the range of 0.1 to 2.7% by weight relative to the total weight of toner-constituting solid matter contained in the mixture. When the addition amount is lower than 0.1% by weight, since the stabilities of respective particles contained in a resin fine particle dispersion, a colorant dispersion, a releasing agent dispersion and the like are different at aggregation, a problem is arisen in some cases that release of a specific particle occurs. On the other hand, when the addition amount exceeds 2.7% by weight, a particle size distribution of aggregated particles is widened, and it becomes difficult to control a particle diameter in some cases.

On the other hand, when a dissolution suspension granulating method is utilized as a process for preparing a toner, a mixture is prepared in which materials constituting a toner such as a binding resin, a colorant, a releasing agent and, if needed, a charge control agent are dissolved once in an organic solvent. Note that, as the organic solvent, for example, ethyl acetate can be used.

Then, in order to prepare a dispersion with the materials constituting a toner therein, a mechanical shearing force is applied to a solution prepared by adding this mixture and a dispersing agent to an aqueous solvent which is immiscible with this mixture, using a shomogenizer such as TK homomixer. Note that, as the dispersing agent, for example, a dispersing agent comprising fine inorganic particles such as calcium phosphate, and an organic series dispersing agent such as polyvinyl alcohol and sodium polyacrylate can be used.

Thereafter, this dispersion is added, for example, to 1 M hydrochloric acid, a dispersing agent component is dissolved, and removed and, thereafter, solid-liquid separation is performed with a suction funnel (Nutsche) using a filter, to obtain solid matters. Finally, the solvent component remaining in solid matters can be distilled off to obtain a toner.

Polymerizable monomers employed in preparing resin particles used in a wet process for preparing a toner as described above is not particularly limited, but for example, monomers and polymers such as styrenes such as styrene, parachlorostyrene, and α-methylstyrene, esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate, vinylnitriles such as acrylonitrile and methacrylonitrile, vinyl ethers such as vinyl methyl ether and vinyl isobutyl ether, vinyl ketones such as vinyl methyl ketone, vinyl ethyl ketone and vinyl isopropenyl ketone, and polyolefins such as ethylene, propylene and butadiene can be used.

Further, as a cross-linking component, for example, acrylic esters such as pentanediol diacrylate, hexanediol diacrylate, decanediol diacrylate and nonanediol diacrylate can be used.

Alternatively, in addition to polymerizable monomers, a polymer of a polymerizable monomer, a copolymer obtained by combining two or more kinds of polymerizable monomers, and a mixture of them can be used. Additionally, an epoxy resin, a polyester resin, a polyurethane resin, a polyamide resin, a cellulose resin, a polyether resin and the like, a non-vinyl fused resin, or a mixture of these resins and the aforementioned vinyl series resin, and a graft polymer obtained upon polymerization of vinyl series monomer in the presence of them can be used.

When a vinyl series monomer is used as a polymerizable monomer, a resin particle dispersion can be prepared by performing emulsion polymerization or suspension polymerization, depending on its process, using an ionic surfactant.

Alternatively, when other resin is used in preparation of a resin particle, if this resin is oily and has the solubility relative to a solvent having the relatively low solubility in water, a resin fine particle dispersion can be prepared, for example, as follows:

First, a solution in which a resin is dissolved in a solvent having the low solubility in water, together with an ionic surfactant and a polymer electrolyte is added to water to prepare a mixture. Then, this mixture is dispersed with a dispersing machine such as a homogenizer, and thereafter, a solvent is volatilized by heating or evacuating, whereby, a resin fine particle dispersion can be prepared.

Note that, a particle diameter of the resulting resin fine particle dispersion can be measured, for example, with a laser diffraction particle size distribution measuring apparatus (LA-700 manufactured by Horiba, Ltd.).

As a colorant contained in a toner used in the invention, the known colorants can be used. Representative examples thereof include magnetic powders such as magnetite and ferrite, carbon black, aniline blue, carcoyl blue, chrome yellow, ultramarine blue, Dupont oil red, quinoline yellow, methylene blue chloride, phthalocyanine blue, Malachite green oxalate, lamp black, Rose Bengal, C.I. Pigment Red 48:1, C.I. Pigment Red 122, C.I. Pigment Red 57:1, C.I. Pigment Red 185, C.I. Pigment Yellow 97, C. I. Pigment Yellow 74, C.I. Pigment Yellow 17, C. I. Pigment Blue 15:1, C.I. Pigment Blue 15:3.

These colorants are dispersed by the known method and, for example, rotation shearing-type homogenizer, media type dispersing machine such as ball mill, sand mill and attritor, a high pressure counter-collision type dispersing machine and the like are preferably used.

When a pigment or a dye is used as a colorant, an amount of a colorant to be added to a toner is preferably 3 to 20%, more preferably 4 to 10% by weight relative to a total weight of a toner-constituting solid matters. When an addition amount is smaller than 3% by weight, the tinting strength of a toner becomes insufficient in some cases, and the highest possible addition amount is preferable if the smoothness of the image surface after fixation is not deteriorated. When a content of a colorant is increased, upon obtaining of an amount having the same concentration, a thickness of an image can be decreased, and this is advantageous in the higher image quality and prevention of offset. When magnetite or ferrite is used as the colorant, an addition amount is preferably in the range of 3 to 60% by weight, more preferably in the range of 10 to 30% by weight relative to a total weight of a toner-constituting solid matters.

As a releasing agent contained in a toner used in the invention, a substance having a main maximum peak as measured according to ASTMD 3418-8 in the range of 70 to 135° C. is preferable.

When the main maximum peak is lower than 70° C., offset easily occurs at fixation in some cases. On the other hand, when the peak exceeds 135° C., a fixing temperature becomes high, the smoothness of the surface of a fixed image can not be achieved, and the glossiness of an image is deteriorated in some cases. In addition, when an oilless fixing process is used upon image formation, since a viscosity thereof is generally increased, a melting viscosity of a releasing agent itself is increased at heating fixation, and dissolution out becomes difficult and, therefore, the peelability is deteriorated.

For measuring the main maximum peak, for example, DSC-7 manufactured by Perkin Elmer Co., Ltd. can be used. For correcting a temperature at a detecting part of this apparatus, a melting point of indium and that of zinc are used and, for correcting a heat amount, the melting heat of indium is used. Measurement is performed by setting a sample by packing a sample in an aluminum pan, setting the pan into an apparatus, and setting a vacant pan as a control, and setting a temperature rising rate at 10° C./min.

In addition, it is preferable that a viscosity of a releasing agent at a temperature at initiation of fixation, for example, at 150° C. is 30 mPa·s or less. When the viscosity exceeds 30 mPa·s, the property of dissolution out at fixation is deteriorated, the peelability is deteriorated, and offset easily occurs in some cases.

As a releasing agent, low molecular weight polyolefins such as polyethylene, polypropylene and polybutene, silicones having a softening point by heating, fatty acid amides such as oleic acid amide, erucic acid amide, ricinolic acid amide and stearic acid amide, vegetable waxes such as carnauba wax, rice wax, candelilla wax, Japan wax and jojoba oil, animal waxes such as beewax, mineral or petroleum waxes such as Montan wax, ozokerite, ceresin, paraffin wax, microcrystalline wax and Fischer-Tropsche wax and modifications thereof can be used.

A dispersion using these waxes can be prepared as follows: first, a wax together with an ionic surfactant and a polymer electrolyte such as a polymer acid and a polymer base is dispersed in water, and the mixture is heated at a melting point of the wax or higher, and the wax in the mixture is finely-divided by applying strong shear by a homogenizer or a pressure discharging-type dispersing machine. A wax particle in the thus prepared dispersion is present in the state where its particle diameter is 1 μm or less.

A particle diameter of the resulting releasing agent particle dispersion can be measured, for example, with a laser diffraction particle size distribution measuring apparatus (LA-700: manufactured by Horiba, Ltd.).

It is preferable that an addition amount of a releasing agent is in the range of 8 to 20% by weight relative to a total weight of a toner-constituting solid matters. In an oilless fixing process, when an addition amount is smaller than 8% by weight, the peelability is deteriorated and a high temperature offset is disadvantageous. On the other hand, when the addition amount is larger than 20% by weight, the flowability is extremely deteriorated and, at the same time, an electrification distribution becomes very wide in some cases.

In addition, in order to stabilize improvement in the electrifiability of a toner, a charge control agent can be used. As the charge control agent, various charge control agents which are normally used, such as a quaternary ammonium salt compound, a nigrosin series compound, a dye comprising a complex of aluminum, iron or chromium, and a triphenylmethane series pigment can be used and, from a viewpoint of control of the ionic strength influencing the stability at aggregation and coalescence, and reduction in waste water pollution, a material which is hardly dissolved in water is suitable.

In addition, for stabilizing the electrifiability of a toner, fine inorganic particles can be added to a toner by a wet process. As an example of fine inorganic particles to be added, all fine inorganic particles which are normally used as an external additive for the toner surface, such as silica, alumina, titania, calcium carbonate, magnesium carbonate, and tricalcium phosphate can be used by dispersing with an ionic surfactant, a polymer acid or a polymer base.

In addition, for the purpose of imparting the flowability to a toner and improving the cleanability, inorganic particles such as silica, alumina, titania and calcium carbonate, and resin fine particles such as vinyl series resin, polyester and silicone as a flowability aid or a cleaning aid can be added to the toner surface by applying shear in the dry state.

[Carrier]

A carrier used in the invention is not particularly limited, but the known carrier can be used. An example thereof includes a resin-coated carrier having a resin covering layer on the core material surface. Alternatively, a resin dispersion-type carrier may be used in which a magnetic material, an electrically conducting material and so on, is dispersed in a matrix resin.

Examples of the covering resin and the matrix resin used in a carrier include polyethylene, polypropylene, polystyrene, polyacrylonitrile, polyvinyl acetate, polyvinyl alcohol, polyvinyl butyral, polyvinyl chloride, polyvinyl carbazole, polyvinyl ether, polyvinyl ketone, vinyl chloride-vinyl acetate copolymer, styrene-acrylic acid copolymer, straight silicone resin comprising an organosiloxane linkage or a modification thereof, fluorine resin, polyester, polyurethane, polycarbonate, phenol resin, amino resin, melanine resin, benzoguanamine resin, urea resin, amide resin, epoxy resin and the like, being not limiting.

Examples of the electrically conducting material are not limited to, but include a metal such as gold, silver and copper, carbon black, titanium oxide, zinc oxide, barium sulfate, aluminum borate, potassium titanate, tin oxide, carbon black and the like.

Examples of the core material for a carrier include magnetic metals such as iron, nickel and cobalt, magnetic oxides such as ferrite and magnetite, glass bead and the like. In order that a carrier is used in a magnetic brushing method, the core material is preferably a magnetic material. A volume average particle diameter of the core material for the carrier is generally 10 to 500 μm, preferably 30 to 100 μm.

[Preparation of Developer]

A developer used in the invention, both of a starting developer and a supplementary developer, is prepared by mixing the aforementioned carrier and toner at an appropriate compounding ratio, provided that, it is necessary to use a toner meeting the shape and shape distribution shown in the above (1) to (3) items at least in the supplementary developer.

A content of a carrier contained in a starting developer ((carrier)/(carrier+toner)×100) is preferably in the range of 85 to 99% by weight, more preferably in the range of 87 to 98% by weight, further preferably in the range of 89 to 97% by weight.

On the other hand, a content of a carrier contained in the supplementary developer is preferably in the range of 5 to 40% by weight, more preferably in the range of 6 to 30% by weight. When a content of a carrier is smaller than 5% by weight, the sufficient effect can not be developed in suppression of deterioration in electrification, prevention of change in resistance and, therefore, suppression of change in image quality in some cases.

In addition, a developer which has become excessive in a developing device due to supply of a supplementary developer is collected from the developing device and, when a content of a carrier in the supplementary developer is larger than 40% by weight, an amount of the developer to be collected from the developing device becomes larger in some cases. For that reason, it becomes necessary to increase a volume of a container for storing a developer after collection, and it is not suitable for miniaturizing of an image forming apparatus for which special restriction is required in some cases.

[Trickle Development and Tandem-type Image Formation]

The image forming method of the invention is performed by utilizing a tandem-type. This tandem-type image formation is performed via at least two or more toner image forming processes comprising at least an electrifying step of electrifying the surface of a latent image-carrier; a latent image forming step of forming a latent image on the surface of the electrified latent image-carrier; and a developing step of forming a toner image by developing the latent image formed on the surface of the latent image-carrier with an electrostatic image developer, which is stored in a developing device and contains a toner and a carrier, and an image is formed on a transfer receiving material via at least a toner image overlaying step of successively overlaying a toner image formed by each of the two or more toner image forming processes.

Here, in at least one of the two or more toner image forming processes, the developing step is performed while appropriately supplying a supplementary developer containing a toner and a carrier to a developing device, and collecting excess electrostatic image developer that appears in the developing device due to the supplying of the supplementary developer (so-called trickle development).

Upon this, in the image forming method of the invention, trickle development is applied to the developing step in at least one of two or more toner image forming processes, and is preferably applied to the developing step in all of the image forming processes. In such the case, since deterioration with time in the electrifiability, the developability, the transferability and the fixability is hardly caused in developers corresponding to all colors, even when image formation is performed over a longer period of time, an image of a high quality can be formed stably.

In addition, the image forming method of the invention includes two or more toner image forming processes, and this does not mean that the toner image forming process is repeated two times, but means that there are two or more independent toner image forming processes corresponding to toner images of respective colors and capable of forming toner images generally at the same time.

In addition, each toner image forming process is not particularly limited as far as it includes the aforementioned three steps, that is, the electrifying step, the latent image forming step and the developing step.

After the developing step is completed, the toner image of each color formed via the toner image forming process corresponding to each color is transferred onto a transfer receiving material. Transfer of the toner image may be performed once, or may be repeated twice or more times.

In addition, by performing a toner image overlaying step of successively overlaying a toner image on a transfer receiving material upon transfer of a toner image, a full color toner image corresponding to original image information is formed.

Note that, the electrifying step, the latent image forming step and the developing step may be any of the known methods as far as image formation by the image forming method of the invention is not interfered. For example, a roll electrification type may be used in the electrifying step. In addition, a cleaning step for cleaning the surface of a latent image-carrier after a toner image is transferred onto a transfer receiving medium may be added.

In the image forming method of the invention, as far as a toner image of each color formed via a toner image forming process is overlaid at least until a fixed image is formed on a recording medium, steps after via a toner image forming process are not particularly limited.

Regarding steps after via a toner image forming process, the case where developers (toners) of four colors of cyan, magenta, yellow and black are used, and there are toner image forming processes corresponding to these four colors will be specifically described below.

In this case, for example, in order to obtain a four-color toner image via one time transferring step, all mono-color toner images(four colors) are transferred onto a transfer receiving medium by overlaying them and, thereafter, the four-color toner image can be fixed on a recording medium.

As another example, there is the case where a transferring step is performed by two stages. In this case, at a first stage transferring step, a two-color toner image is formed on a transfer receiving medium by transferring and overlaying two mono-color images onto the transfer receiving medium (e.g. a two-color toner image composed of overlaying of cyan and magenta, a two-color toner image composed of overlaying of yellow and black) and, at a second stage transferring step, a four-color toner image is formed on a transfer receiving medium by transferring and overlaying two two-color toner images onto the transfer receiving medium, thereafter, the four-color toner image can be fixed on the recording medium.

In the image forming method of the invention, formation of an image is performed at a constant process speed, and image formation may be performed by switching over this process speed depending on a kind of a recording medium used in image formation and desired image quality. The process speed corresponds to a rate of image formation per unit time, and can be expressed, for example, as mm/s.

<Image Forming Apparatus>

Then, the image forming apparatus of the invention will be described. The image forming apparatus of the invention is not particularly limited as far as it is an apparatus having the construction by which the image forming method of the invention can be implemented, but specifically it is preferable that the image forming apparatus has the following construction.

That is, it is preferable that the image forming apparatus of the invention is an image forming apparatus, which comprises at least: two or more developing units provided with at least a latent image-carrier, an electrifying means for electrifying the surface of the latent image-carrier, latent image forming means for forming a latent image on the surface of the electrified latent image-carrier, and a developing device for storing an electrostatic image developer containing a toner and a carrier, wherein the developing device develops the latent image formed on the surface of the latent image-carrier with the electrostatic image developer, so as to form a toner image; and a toner image overlaying means for successively overlaying a toner image, which is formed by each of the two or more developing units, onto a transfer receiving material, wherein at least one of the two or more developing units is provided with at least a developer supplying means for appropriately supplying a supplementary developer containing a toner and a carrier to a developing device, and a developer collecting means for collecting excess electrostatic image developer that appears in the developing device due to the supplying of the supplementary developer, and (1) an average circularity of a toner contained in at least the supplementary developer is in the range of 0.940 to 0.980; (2) a ratio of the number of particles having an average circularity of 0.970 or greater, in a particle diameter range of a toner circle-equivalent diameter×3/5 or less, is 5% or less; and (3) a ratio of the number of the particles having an average circularity of 0.950 or less, in a particle diameter range of a toner circle-equivalent diameter×7/5 or greater, is 10% or less.

Therefore, according to the image forming apparatus of the invention, deterioration with time in the electrifiability, the developability, the transferability and the fixability is hardly caused and, even when image formation is performed over a longer period of time, an image of the high quality can be stably formed as compared with the previous tandem-type image forming apparatus using the trickle developing system.

It is enough that a toner used in the image forming apparatus of the invention has at least the shape and shape distribution shown in the above (1) to (3) items and, as described above, the same toner as that used in the image forming method of the invention can be utilized. In addition, the image forming apparatus of the invention is not particularly limited as far as the toner having the shape and shape distribution shown in the above (1) to (3) items is contained in at least a supplementary developer, and it is preferable that such the toner is contained also in a starting developer.

The image forming apparatus of the invention is not particularly limited as far as at least one of developing units includes trickle developing system composed of developer supplying means and developer collecting means as described above, but it is preferable that all developing units contain developer supplying means and developer collecting means. In such the case, since deterioration with time in the electrifiability, the developability, the transferability and the fixability is hardly occurred in developers corresponding to all colors, an image of the high quality can be formed stably even when image formation is performed over a further longer period of time.

In addition, the trickle developing system applied to developing units can save maintenance of a developer. In order to realize such the saving of maintenance and, further, maintenance free, it is of course desirable to apply the trickle developing system to more developing units, and it is most desirable to apply the trickle developing system to all developing units.

Supply of a supplementary developer to a developing device with developer supplying means can be appropriately performed depending on a consumed amount of a toner in the developing device. As a general method of controlling an amount of a supplementary developer to be supplied, there is a method of successively supplying a supplementary developer from developer supplying means to a developing device so that the concentration of a toner in the developing device is held in a fixed range using a toner concentration sensor provided in the developing device. And, a excess developer that appears in the developing device due to the supplying of a supplementary developer is discharged to the outside of the developing device, usually, by overflowing from a developer storing part provided in the developing device, and is collected in a collecting container.

It is preferable that the developer supplying means comprises a toner cartridge. In the invention, the "toner cartridge" has the function of appropriately supplying the above-described supplementary developer containing a toner and a carrier, and has the construction that the aforementioned supplementary developer is stored, and the toner cartridge is detachable from an image forming apparatus. In such the case, by exchanging a toner cartridge, a supplementary developer can be easily supplemented to an image forming apparatus. And, since supply of a supplementary developer can be performed per a cartridge unit, maintenance is easy.

A toner image formed by each of developing units is transferred onto a transfer receiving material. Transfer of a toner image may be one time, or may be repeated twice or more times. Upon transfer, toner images are overlaid and, when the number of transferring means to be used is one, transferring means serves also as means for overlaying toner images and, when the number of transferring means is plural, at least 1 or more transferring means serve also as means for overlaying toner images. As the transferring means, the known transferring means such as an intermediate transferring belt and an intermediate transferring drum can be used.

When transfer is performed only once, a transfer receiving material is a recording medium such as a paper and a OHP film, and toner images are successively overlaid on a recording medium and, thereafter, fixation is performed.

In particular, when a full color image is formed using the image forming apparatus of the invention, from a viewpoint of the flexibility about papers and the high image quality, it is preferable that toner images of respective colors are successively transferred onto the surface of a transfer receiving material (a transfer receiving medium except for a recording medium: e.g. an intermediate transferring belt and intermediate transferring drum), and overlaid, thereafter, color toner images obtained by overlaying are transferred onto the surface of recording medium such as paper and the like at once.

As far as the image forming apparatus of the invention is provided with two or more developing units, and toner image overlaying means, and at least one of the two or more developing units is provided with developer supplying means and developer collecting means as described above, respective members constituting them are not particularly limited, and may be provided with any other known members.

For example, as respective constituent members such as a latent image-carrier and an electrifying equipment used in a developing unit, an intermediate transferring belt (or intermediate transferring drum) used as transferring means and the like, any known members may be adopted.

But, it is preferable that electrifying means is a roll electrification type electrifying device in that the environmental retainability due to reduction in occurrence of ozone can be realized at a higher dimension.

In addition, it is preferable that the image forming apparatus of the invention has cleaning means for cleaning the surface of a latent image-carrier. As this cleaning means, blade cleaning type can be generally used preferably because that type is excellent in the cost and the performance stability.

In order to allow an approximately spherical toner to be cleaned, it is desirable to optimize control of the physical properties of a blade and contact conditions. Even when a toner (more preferably, a toner with an external additive of a combination of monodisperse spherical silica, a polishing agent and a lubricant added thereto) used in the invention remains on the surface of a latent image-carrier, such the cleaning means using a blade can clean this remaining toner stably. For this reason, a latent image-carrier can prolong a life greatly by improving the resistance to abrasion thereof. In addition, when a latent image-carrier is drum-like, cleaning means is provided on an outer circumferential surface of a latent image-carrier. Thereupon, letting a position of cleaning means on an external circumferential surface of a drum-like latent image-carrier to be a datum point, an electrostatic brush may be arranged on either side of a forward side (downstream) and a reverse side (upstream) in a direction of rotation of the drum-like latent image-carrier.

As the electrostatic brush, a fibrous material composed of a resin containing an electrically conducting filler such as fine inorganic particles, or a fibrous material having the surface covered with the aforementioned electrically conducting filler can be used, being not limiting.

<Toner Cartridge>

Then, the toner cartridge of the invention will be described. It is preferable that the toner cartridge of the invention is a toner cartridge used in an image forming apparatus, comprising at least: two or more developing units provided with at least a latent image-carrier, an electrifying means for electrifying the surface of the latent image-carrier, latent image forming means for forming a latent image on the surface of the electrified latent image-carrier, and a developing device for storing an electrostatic image developer containing a toner and a carrier, wherein the developing device develops the latent image formed on the surface of the latent image-carrier with the electrostatic image developer, so as to form a toner image; and a toner image overlaying means for successively overlaying a toner image, which is formed by each of the two or more developing units, onto a transfer receiving material, wherein at least one of the two or more developing units is provided with at least a toner cartridge for storing a supplementary developer containing a toner and a carrier, and appropriately supplying the supplementary developer to a developing device; and a developer collecting means for collecting excess electrostatic image developer that appears in the developing device due to the supplying of the supplementary developer, and (1) an average circularity of a toner contained in a supplementary developer stored in the toner cartridge is in the range of 0.940 to 0.980; (2) a ratio of the number of particles having an average circularity of 0.970 or greater, in a particle diameter range of a toner circle-equivalent diameter×3/5 or less, is 5% or less; and (3) a ratio of the number of particles having an average circularity of 0.950 or less, in a particle diameter range of a toner circle-equivalent diameter×7/5 or greater, is 10% or less.

Since the toner cartridge of the invention stores a supplementary developer containing a toner having the shape and shape distribution shown in the above (1) to (3) items, by attaching the toner cartridge of the invention in place of the previous toner cartridge, to a tandem-type image forming apparatus using the trickle developing system which can supplement a supplementary developer with a toner cartridge, an image of the high quality can be formed stably even when image formation is performed over a longer period of time.

In addition, it is enough that a toner contained in a supplementary developer stored in the toner cartridge of the invention has at least the shape and shape distribution shown in the above (1) to (3) items, and the same toner as that used in the image forming method of the invention can be utilized as already described.

As described above, the image forming method of the invention has been described, in the invention, as far as the invention is provided with essential features of the invention, regarding other arbitrary elements, any variation and modification can be performed by the known findings, being not limiting.

EXAMPLES

The present invention will be described specifically by way of Examples below. However, the invention is not limited by the following Examples.

[Preparation of Toner]

Preparation of a toner is performed using an aggregating and coalescing method as described above. Specifically, a first resin fine particle dispersion, a colorant dispersion and a releasing agent dispersion are each prepared. Then, while stirring a mixture in which these dispersions are mixed at predetermined amounts, a polymer containing inorganic metal salt is added to this mixture to ionically neutralize them and form an aggregate (core aggregate) of each fine particle contained in the aforementioned three kinds of dispersions.

Thereafter, a second resin fine particle dispersion is additionally added to a mixture in which the core aggregate is formed so that a desired toner diameter is obtained, whereby, resin fine particles contained in the second resin fine particle dispersion are adhered to the surface of the core aggregate to form a surface layer and obtain core/shell-type aggregated particles.

Then, an inorganic base compound is added to a mixture containing the core/shell-type aggregated particles to adjust a pH of the mixture in weak acidic condition to neutral condition, and the mixture is heated to glass transition temperatures of a binding resin constituting the core/shell-type aggregated particles or higher to coalesce and fuse it. After completion of the reaction, a toner is obtained by performed washing steps, solid-liquid separation steps, and drying steps.

In the dissolution emulsification/aggregating and coalescing method, polymerizable monomers are pre-polymerized, emulsified with a mechanical shearing force in the presence of a surfactant, and, then, thermally polymerized in the presence of an aqueous polymerization initiator to obtain emulsified resin fine particles. Thereafter, a toner is obtained by performed the aggregating and coalescing method using the emulsified resin fine particles.

[Preparation of Resin Fine Particle Dispersion (1)]

Styrene (manufactured by Wako Pure Chemical Industries, Ltd.)
229.5 parts by weight n-Butyl acrylate (manufactured by Wako Pure Chemical Industries, Ltd.)
70.5 parts by weight β-Carboxyethyl acryrlate (manufactured by Rhodia Nikka, Ltd.)
9 parts by weight 1,10-Decanediol diacrylate (manufactured by Shin-Nakamura Chemical Co., Ltd.)
1.1 parts by weight Dodecanethiol (manufactured by Wako Pure Chemical Industries, Ltd.)
4.7 parts by weight A solution in which the aforementioned components are mixed and dissolved, is dispersed and emulsified in a solution obtained by dissolving 6.4 parts by weight of an anionic surfactant Dowfax (manufactured by the Dow Chemical Company) in 400 parts by weight of ion-exchanged water, in a flask, and 50 parts by weight ion-exchanged water with 4.5 parts by weight of ammonium persulfate dissolved therein is added in the flask therein while slowly stirring and mixing the emulsion for 10 minutes.

Then, nitrogen replacement in the flask is sufficiently performed, the flask is heated by an oil bath while stirring until the system reached 70° C., and emulsion polymerization is continued for 5 hours. Whereby, an anionic resin fine particle dispersion 1 having a central particle diameter of 195 nm, a solid matters amount of 42%, a glass transition point of 51.5° C. and a weight average molecular weight (Mw) of 29000 is obtained.

| (Preparation of colorant dispersion 1) | |
|---|---|
| Blue pigment (ECB301: manufactured by Dainichiseika Color & Chemicals Mfg. Co., Ltd.) | 80 parts by weight |
| Anionic surfactant Neogen SC (manufactured by Dai-ichi Kogyo Seiyaku Co., Ltd.) | 8 parts by weight |
| Ion-exchanged water | 200 parts by weight |

A solution in which the aforementioned components are mixed and dissolved, is dispersed for 10 minutes using a homogenizer (Ultratalax T50: manufactured by IKA) and, then, an ultrasound at 28 kHz is irradiated for 5 minutes (×2) using an ultrasound dispensing machine at the solution, to obtain a colorant dispersion 1 containing a colorant particle having a central particle diameter of 118 nm.

| (Preparation of colorant dispersion 2) | |
|---|---|
| Yellow pigment (5GX03: manufactured by Clariant (Japan) K.K.) | 80 parts by weight |
| Anionic surfactant Neogen SC (manufactured by Dai-ichi Kogyo Seiyaku Co., Ltd.) | 8 parts by weight |
| Ion-exchanged water | 200 parts by weight |

A solution in which the aforementioned components are mixed and dissolved, is dispersed for 10 minutes using a homogenizer (Ultratalax T50: manufactured by IKA) and, then, an ultrasound at 28 kHz is irradiated for 20 minutes using an ultrasound dispensing machine at the solution, to obtain a colorant dispersion 2 containing a colorant particle having a central particle diameter of 108 nm.

| (Preparation of colorant dispersion 3) | |
|---|---|
| Red pigment (ECR186Y: manufactured by Dainichiseika Color & Chemicals Mfg. Co., Ltd.) | 80 parts by weight |
| Anionic surfactant Neogen SC (manufactured by Dai-ichi Kogyo Seiyaku Co., Ltd.) | 80 parts by weight |
| Ion-exchanged water | 200 parts by weight |

A solution in which the aforementioned components are mixed and dissolved, is dispersed for 10 minutes using a homogenizer (Ultratalax T50: manufactured by IKA) and, then, an ultrasound at 28 kHz is irradiated for 10 minutes using an ultrasound dispensing machine at the solution, to obtain a colorant dispersion 3 containing a colorant particle having a central particle diameter of 132 nm.

| (Preparation of colorant dispersion 4) | |
|---|---|
| Carbon black (R330: manufactured by Cabot Corporation) | 80 parts by weight |

-continued

| (Preparation of colorant dispersion 4) | |
|---|---|
| Anionic surfactant Neogen SC (manufactured by Dai-ichi Kogyo Seiyaku Co., Ltd.) | 80 parts by weight |
| Ion-exchanged water | 200 parts by weight |

A solution in which the aforementioned components are mixed and dissolved, is dispersed for 10 minutes using a homogenizer (Ultratalax T50: manufactured by IKA) and, then, an ultrasound at 28 kHz is irradiated for 10 minutes using an ultrasound dispensing machine at the solution, to obtain a colorant dispersion 4 containing a colorant particle having a central particle diameter of 125 nm.

| (Preparation of releasing agent dispersion 1) | |
|---|---|
| Polyethylene wax Polywax 725 (melting point 103° C.: manufactured by Toyo-Petrolite) | 45 parts by weight |
| Anionic surfactant Neogen RK (manufactured by Dai-ichi Kogyo Seiyaku Co., Ltd.) | 5 parts by weight |
| Ion-exchanged water | 200 parts by weight |

A solution in which the above components are mixed, heated to 120° C., dispersed well with Ultratalax T50 manufactured by IKA, and dispersion-treated with a pressure discharging-type Golin homogenizer, to obtain a releasing agent dispersion 1 containing a releasing agent fine particle having a central particle diameter of 220 nm.

(Preparation of Releasing Agent Dispersion 2)

According to the same procedures as those for preparation of the releasing agent dispersion 1 except that polypropylene wax Ceridust6071 (melting point 130° C.: manufactured by Clariant (Japan) K.K.) is used in place of polyethylene wax Polywax 725, a releasing agent dispersion 2 containing a releasing agent fine particle having a central particle diameter of 302 nm is obtained.

(Preparation of Releasing Agent Dispersion 3)

According to the same procedures as those for preparation of the releasing agent dispersion 1 except that paraffin wax HNP0190 (melting point 85° C.: manufactured by Nippon Seiro Co., Ltd.) is used in place of polyethylene wax PW 725, a releasing agent dispersion 3 containing a releasing agent fine particle having a central particle diameter of 192 nm is obtained.

(Preparation of Releasing Agent Dispersion 4)

According to the same procedures as those for preparation of the releasing agent dispersion 1 except that paraffin wax HNP5 (melting point 62° C.: manufactured by Nippon Seiro Co., Ltd.) is used in place of polyethylene wax Polywax 725, a releasing agent dispersion 4 containing a releasing agent fine particle having a central particle diameter of 176 nm is obtained.

| <Preparation of toner 1> | |
|---|---|
| Resin fine particle dispersion 1 | 120.0 parts by weight |
| Colorant dispersion 1 | 20.4 parts by weight |
| Releasing agent dispersion 1 | 62.5 parts by weight |
| Polyaluminum chloride (manufactured by Asada Kagaku Kogyo) | 1.5 parts by weight |

The above components are mixed and dispersed well with Ultrartalax T50 in a round-type stainless flask.

Then, the flask is heated to 47° C. with a heating oil bath while stirring. After retained at 47° C. for 60 minutes, 62.4 parts by weight of a dispersion (resin fine particle dispersion 1) is slowly added thereto.

Thereafter, a pH of the solution in the flask is adjusted to 5.4 with 0.5 Mol/L of an aqueous sodium hydroxide solution, the stainless flask is sealed, and heated to 96° C. while continuing to stir using a magnetic force sealing, followed by retaining at that temperature for 5 hours.

After completion of the reaction, the solution is cooled ,and subjected to solid-liquid separation by Nutsche type suction filtration. Then the solid separated from the solution is washed well by addition of ion-exchanged water. The solid after washed is further redispersed in 3 L of ion-exchanged water at 40° C., and stirred and washed at 300 rpm for 15 minutes.

This treatment is further repeated five times and, at a point at which a pH of the filtrate became 6.85, the electrical conductivity became 9.7 μS/cm, and the surface tension became 70.1 Nm, solid-liquid separation of the filtrate is performed by Nutsche type suction filtration using No. 5A filter to obtain a solid. Then, vacuum drying of the solid is continued for 12 hours to obtain a toner 1.

A particle diameter of this toner 1 is measured with a coulter counter, and a volume average diameter D50(v) is found to be 5.9 μm, a volume average particle size distribution index GSD (v) is found to be 1.19, GSD (p) is found to be 1.21, and GSD (punder) is found to be 1.23. In addition, the toner is measured with an image analyzing apparatus FPIA, and an average circularity of the toner is found to be 0.965.

Here, GSD(v) is the volume average particle size distribution index expressed as $(D16(v)/D84(v))^{1/2}$, GSD(p) is the number average particle size distribution index expressed as $(D16(p)/D84(p))^{1/2}$, GSD(punder) is the lower side number average particle diameter distribution index expressed as D50(p)/D16(p); D16(v) and D84(v) represent the 16% volume diameter and 84% volume diameter respectively, obtained by counting from a large particle diameter side; D16(p) and D84(p) represent the 16% number diameter and the 84% number diameter respectively, obtained by A circle-equivalent diameter of the toner is 6.0 μm, a ratio of the number of particles having an average circularity of 0.970 or greater, in a particle diameter range of a toner circle-equivalent diameter×3/5 or less, is 1.9%, and a ratio of the number of particles having an average circularity of 0.950 or less, in a particle diameter range of a toner circle-equivalent diameter×7/5 or greater, is 4.7%. In other words, 1.9% is a ratio of a number of particles having a circularity of 0.970 or greater among particles having a diameter less than or equal to 3/5 of a specific circle-equivalent diameter to a total number of particles having a diameter less than or equal to 3/5 of the specific circle-equivalent diameter. Moreover, 4.7% is a ratio of a number of particles having a circularity of 0.950 or less among particles having a diameter greater than or equal to 7/5 of the specific circle-equivalent diameter to a total number of particles having a diameter greater than or equal to 7/5 of the specific circle-equivalent diameter. In addition, a dielectric constant of the toner is 1.5, and a dielectric loss tangent tan δ is 0.006.

According to the same procedures as those for preparation of the toner 1 except that a coalescing time is 6.5 hours, a releasing agent dispersion 2 is used, an addition amount is 104 parts by weight, a toner 2 is obtained.

In this toner 2, D50(v) is 6.0 μm, a volume average particle size distribution index GSD (v) is 1.20, GSD (p) is 1.23, GSD (punder) is 1.25, an average circularity is 0.972, a circle-equivalent diameter is 6.1 μm, a ratio of the number of particles having an average circularity of 0.970 or greater, in a particle diameter range of a toner circle-equivalent diameter×3/5 or less, is 3.6%, and a ratio of the number of particles having an average circularity of 0.950 or less, in a particle diameter range of a toner circle-equivalent diameter×7/5 or greater, is 1.2%. In addition, a dielectric constant of the toner is 1.0, and a dielectric loss tangent tan b is 0.004.

<Preparation of Toner 3>

According to the same procedures as those for preparation of the toner 1 except that a coalescing time is 3.5 hours, and a colorant dispersion 2 and a releasing agent dispersion 3 are used, a toner 3 is obtained.

In this toner 3, D50(v) is 6.1 μm, a volume average particle size distribution index GSD (v) is 1.22, GSD (p) is 1.20, GSD (punder) is 1.22, an average circularity is 0.959, a circle-equivalent diameter is 6.2 μm, a ratio of the number of particles having an average circularity of 0.970 or greater, in a particle diameter range of a toner circle-equivalent diameter×3/5 or less, is 1.1%, and a ratio of the number of particles having an average circularity of 0.950 or less, in a particle diameter range of a toner circle-equivalent diameter×7/5 or greater, is 9.0%. In addition, a dielectric constant of the toner is 1.9, and a dielectric loss tangent tan δ is 0.018.

<Preparation of Toner 4>

According to the same procedures as those for preparation of the toner 1 except that an aggregating temperature is 42° C., an amount of an aggregating agent is 1.0 parts by weight, and a colorant 3 is used, a toner 4 is obtained.

In this toner 4, D50(v) is 3.7 μm, a volume average particle size distribution index GSD (v) is 1.22, GSD (p) is 1.23, GSD (punder) is 1.26, an average circularity is 0.968, a circle-equivalent diameter is 3.7 μm, ratio of the number of particles having an average circularity of 0.970 or greater, in a particle diameter range of a toner circle-equivalent diameter×3/5or less, is 4.8%, and a ratio of the number of particles having an average circularity of 0.950 or less, in a particle diameter range of a toner circle-equivalent diameter×7/5 or greater, is 5.7%. In addition, a dielectric constant of the toner is 1.6, and a dielectric loss tangent tan δ is 0.010.

<Preparation of Toner 5>

According to the same procedures as those for preparation of the toner 1 except that an amount of a releasing agent dispersion 1 is 104 parts by weight, and a colorant dispersion 4 is used, a toner 5 is obtained.

In this toner 5, D50(v) is 6.2 μm, a volume average particle size distribution index GSD (v) is 1.24, GSD (p) is 1.24, GSD (punder) is 1.26, an average circularity is 0.951, a circle-equivalent diameter is 6.3 μm, a ratio of the number of particles having an average circularity of 0.970 or greater, in a particle diameter range of a toner circle-equivalent diameter×3/5 or less, is 4.0%, and a ratio of the number of particles having an average circularity of 0.950 or less, in a particle diameter range of a toner circle-equivalent diameter×7/5 or greater, is 2.2%. In addition, a dielectric constant of the toner is 1.9, and a dielectric loss tangent tan δ is 0.017.

<Preparation of Toner 6>

According to the same procedures as those for preparation of the toner 1 except that an amount of a releasing agent dispersion 4 to be added is 36.5 parts by weight, and an aggregating temperature is 56° C., a toner 6 is obtained.

In this toner 6, D50(v) is 9.6 μm, a volume average particle size distribution index GSD (v) is 1.21, GSD (p) is 1.22, GSD (punder) is 1.24, an average circularity is 0.967, a circle-equivalent diameter is 9.7 μm, a ratio of the number of particles having an average circularity of 0.970 or greater, in a particle diameter range of a toner circle-equivalent diameter×3/5 or less, is 2.4%, and a ratio of the number of particles having an average circularity of 0.950 or less, in a particle diameter range of a toner circle-equivalent diameter×7/5 or greater, is 4.0%. In addition, a dielectric constant of the toner is 2.6, and a dielectric loss tangent tan δ is 0.007.

<Preparation of Toner 7>

According to the same procedures as those for preparation of the toner 1 except that an amount of an aggregating agent is 0.1 part by weight, and an amount of a releasing agent dispersion is 104 parts by weight, a toner 7 is obtained.

In this toner 7, D50(v) is 3.0 μm, a volume average particle size distribution index GSD (v) is 1.19, GSD (p) is 1.25, GSD (punder) is 1.27, an average circularity is 0.980, a circle-equivalent diameter is 3.0 μm, a ratio of the number of particles having an average circularity of 0.970 or greater, in a particle diameter range of a toner circle-equivalent diameter×3/5 or less, is 5.0%, and a ratio of the number of particles having an average circularity of 0.950 or less, in a particle diameter range of a toner circle-equivalent diameter×7/5 or greater, is 1.5%. In addition, a dielectric constant of the toner is 1.0, and a dielectric loss tangent tan b is 0.002.

<Preparation of Toner 8>

According to the same procedures as those for preparation of the toner 1 except that an aggregating temperature is 55° C., a colorant dispersion 4 is used, and an amount of an aggregating agent is 2.7 parts by weight, a toner 8 is obtained.

In this toner 8, D50(v) is 10.0 μm, a volume average particle size distribution index GSD (v) is 1.25, GSD (p) is 1.20, GSD (punder) is 1.22, an average circularity is 0.94, a circle-equivalent diameter is 10.1 μm, a ratio of the number of particles having an average circularity of 0.970 or greater, in a particle diameter range of a toner circle-equivalent diameter×3/5 or less, is 1.1%, and a ratio of the number of particles having an average circularity of 0.950 or less, in a particle diameter range of a toner circle-equivalent diameter×7/5 or greater, is 9.5%. In addition, a dielectric constant of the toner is 2.7, and a dielectric loss tangent tan δ is 0.018.

<Preparation of Toner 9>

According to the same procedures as those for preparation of the toner 1 except that an aggregating temperature is 40° C., an amount of an aggregating agent is 0.9 part by weight, and an amount of a releasing agent dispersion 4 to be added is 234 parts by weight, a toner 9 is obtained.

In this toner 9, D50(v) is 2.7 μm, a volume average particle size distribution index GSD (v) is 1.31, GSD (p) is 1.33, GSD (punder) is 1.36, an average circularity is 0.991, a circle-equivalent diameter is 2.7 μm, a ratio of the number of particles having an average circularity of 0.970 or greater, in a particle diameter range of a toner circle-equivalent diameter×3/5 or less, is 15%, and a ratio of the number of particles having an average circularity of 0.950 or less, in a particle diameter range of a toner circle-equivalent diameter×7/5 or greater, is 3.4%. In addition, a dielectric constant of the toner is 3.2, and a dielectric loss tangent tan δ is 0.056.

<Preparation of Toner 10>

According to the same procedures as those for preparation of the toner 1 except that an aggregating temperature is 55° C., and an amount of an aggregating agent is 4.0 part by weight, a toner 10 is obtained.

In this toner 10, D50(v) is 12.0 μm, a volume average particle size distribution index GSD (v) is 1.35, GSD (p) is 1.27, GSD (punder) is 1.31, an average circularity is 0.932, a circle-equivalent diameter is 12.2 μm, a ratio of the number of particles having an average circularity of 0.970 or greater, in a particle diameter range of a toner circle-equivalent diameter×3/5 or less, is 0.86%, and a ratio of the number of particles having an average circularity of 0.950 or less, in a particle diameter range of a toner circle-equivalent diameter×7/5 or greater, is 15.0%. In addition, a dielectric constant of the toner is 0.9, and a dielectric loss tangent tan δ is 0.001.

<Preparation of Fine Inorganic Particle-Adhered Toner 1•Starting Developer 1•Supplementary Developer 1>

2 Parts by weight of hydrophobic silica (TS720: manufactured by Cabot Corporation), 1 part by weight of titanium oxide, 0.5 part by weight of cerium oxide and 0.3 part by weight of a lubricant as an external additive are mixed into 100 part by weight of a toner 1, and blended with a Henschel mixer at a circumferential rate of 32 m/s for 15 minutes. And crude particles are removed from a toner after blend treatment using a sieve having a 45 μm mesh to obtain fine inorganic particles-adhered toner 1.

The resulting fine inorganic particle-adhered toner is primarily retained in a hopper, the toner is filled into a cartridge from the hopper through an auger, a resin-coated carrier is filled at a ratio of 20 parts by weight of a carrier relative to 100 parts by weight of the toner, and packaged to obtain a toner cartridge with a supplementary developer 1 filled therein (content of the carrier in supplementary developer 1; about 16.7%).

Separately, 8 parts by weight of the aforementioned fine inorganic particle-adhered toner 1 and 100 parts by weight of the aforementioned carrier are stirred at 40rpm for 20 minutes with a V-type blender, and classified with a sieve having a 177 μm mesh to obtain a starting developer 1.

Note that, a flowability index (compression ratio) G1 of the fine inorganic particle-adhered toner 1 is 0.32, and a ratio of a flowability index (compression ratio) G1 relative to the index G2 (G1/G2) is 0.65. Here, the index G2 is measured using a mixture, which is consist of the fine inorganic particle-adhered toner 1 and fine magnetic metal particles having the surface covered with an organic layer, is stirred at an angular frequency of 30 rad/s for 60 minutes.

<Preparation of Fine Inorganic Particle-adhered Toner 2/Starting Developer 2/Supplementary Developer 2>

According to the same procedures as those for preparation of the fine inorganic particle-adhered toner 1/starting developer 1/supplementary developer 1 except that a toner 2 is used, fine inorganic particles-adhered toner 2, a starting developer 2 and a supplementary developer 2 are obtained.

Note that, a flowability index (compression ratio) G1 of the fine inorganic particle-adhered toner 2 is 0.34, and a flowability index (compression ratio) G1 relative to the index G2 (G1/G2) is 0.74. Here, the index G2 is measured using a mixture, which is consist of the fine inorganic particle-adhered toner 2 and fine magnetic metal particles having the surface covered with an organic layer, is stirred at an angular frequency of 30 rad/s for 60 minutes.

<Preparation of Fine Inorganic Particle-adhered Toner 3/Starting Developer 3/Supplementary Developer 3>

According to the same procedures as those for preparation of the fine inorganic particle-adhered toner 1/starting developer 1/supplementary developer 1 except that a toner 3 is used, fine inorganic particles-adhered toner 3, a starting developer 3 and a supplementary developer 3 are obtained.

Note that, a flowability index (compression ratio) G1 of the fine inorganic particle-adhered toner 3 is 0.41, and a flowability index (compression ratio) G1 relative to the index G2 (G1/G2) is 0.77. Here, the index G2 is measured using a mixture, which is consist of the fine inorganic particle-adhered toner 3 and fine magnetic metal particles having the surface covered with an organic layer, is stirred at an angular frequency of 30 rad/s for 60 minutes.

<Preparation of Fine Inorganic Particle-adhered Toner 4/Starting Developer 4/Supplementary Developer 4>

According to the same procedures as those for preparation of the fine inorganic particle-adhered toner 1/starting developer 1/supplementary developer 1 except that a toner 4 is used, fine inorganic particles-adhered toner 4, a starting developer 4 and a supplementary developer 4 are obtained.

Note that, a flowability index (compression ratio) G1 of the fine inorganic particle-adhered toner 4 is 0.36, and a flowability index (compression ratio) G1 relative to the index G2 (G1/G2) is 0.84. Here, the index G2 is measured using a mixture, which is consist of the fine inorganic particle-adhered toner 4 and fine magnetic metal particles having the surface covered with an organic layer, is stirred at an angular frequency of 30 rad/s for 60 minutes.

<Preparation of Fine Inorganic Particle-adhered Toner 5/Starting Developer 5/Supplementary Developer 5>

According to the same procedures as those for preparation of the fine inorganic particle-adhered toner 1/starting developer 1/supplementary developer 1 except that a toner 5 is used, fine inorganic particles-adhered toner 5, a starting developer 5 and a supplementary developer 5 are obtained.

Note that, a flowability index (compression ratio) G1 of the fine inorganic particle-adhered toner 5 is 0.32, and a flowability index (compression ratio) G1 relative to the index G2 (G1/G2) is 0.80. Here, the index G2 is measured using a mixture, which is consist of the fine inorganic particle-adhered toner 5 and fine magnetic metal particles having the surface covered with an organic layer, is stirred at an angular frequency of 30 rad/s for 60 minutes.

<Preparation of Fine Inorganic Particle-adhered Toner 6/Starting Developer 6/Supplementary Developer 6>

According to the same procedures as those for preparation of the fine inorganic particle-adhered toner 1/starting developer 1/supplementary developer 1 except that a toner 6 is used, fine inorganic particles-adhered toner 6, a starting developer 6 and a supplementary developer 6 are obtained.

Note that, a flowability index (compression ratio) G1 of the fine inorganic particle-adhered toner 6 is 0.28, and a flowability index (compression ratio) G1 relative to the index G2 (G1/G2) is 0.59. Here, the index G2 is measured using a mixture, which is consist of the fine inorganic particle-adhered toner 6 and fine magnetic metal particles having the surface covered with an organic layer, is stirred at an angular frequency of 30 rad/s for 60 minutes.

<Preparation of Fine Inorganic Particle-adhered Toner 7/Starting Developer 7/Supplementary Developer 7>

According to the same procedures as those for preparation of the fine inorganic particle-adhered toner 1/starting developer 1/supplementary developer 1 except that a toner 7 is used, fine inorganic particles-adhered toner 7, a starting developer 7 and a supplementary developer 7 are obtained.

Note that, a flowability index (compression ratio) G1 of the fine inorganic particle-adhered toner 7 is 0.38, and a flowability index (compression ratio) G1 relative to the index G2 (G1/G2) is 0.63. Here, the index G2 is measured using a mixture, which is consist of the fine inorganic particle-adhered toner 7 and fine magnetic metal particles having the surface covered with an organic layer, is stirred at an angular frequency of 30 rad/s for 60 minutes.

<Preparation of Fine Inorganic Particle-adhered Toner 8/Starting Developer 8/Supplementary Developer 8>

According to the same procedures as those for preparation of the fine inorganic particle-adhered toner 1/starting developer 1/supplementary developer 1 except that a toner 8 is used, fine inorganic particles-adhered toner 8, a starting developer 8 and a supplementary developer 8 are obtained.

Note that, a flowability index (compression ratio) G1 of the fine inorganic particle-adhered toner 8 is 0.45, and a flowability index (compression ratio) G1 relative to the index G2 (G1/G2) is 0.86. Here, the index G2 is measured using a mixture, which is consist of the fine inorganic particle-adhered toner 8 and fine magnetic metal particles having the surface covered with an organic layer, is stirred at an angular frequency of 30 rad/s for 60 minutes.

<Preparation of Fine Inorganic Particle-adhered Toner 9/Starting Developer 9/Supplementary Developer 9>

According to the same procedures as those for preparation of the fine inorganic particle-adhered toner 1/starting developer 1/supplementary developer 1 except that a toner 9 is used, fine inorganic particles-adhered toner 9, a starting developer 9 and a supplementary developer 9 are obtained.

Note that, a flowability index (compression ratio) G1 of the fine inorganic particle-adhered toner 9 is 0.23, and a flowability index (compression ratio) G1 relative to the index G2 (G1/G2) is 0.41. Here, the index G2 is measured using a mixture, which is consist of the fine inorganic particle-adhered toner 9 and fine magnetic metal particles having the surface covered with an organic layer, is stirred at an angular frequency of 30 rad/s for 60 minutes.

<Preparation of Fine Inorganic Particle-adhered Toner 10/Starting Developer 10/Supplementary Developer 10>

According to the same procedures as those for preparation of the fine inorganic particle-adhered toner 1/starting developer 1/supplementary developer 1 except that a toner 10 is used, fine inorganic particles-adhered toner 10, a starting developer 10 and a supplementary developer 10 are obtained.

Note that, a flowability index (compression ratio) G1 of the fine inorganic particle-adhered toner 10 is 0.31, and a flowability index (compression ratio) G1 relative to the index G2 (G1/G2) is 0.67. Here, the index G2 is measured using a mixture, which is consist of the fine inorganic particle-adhered toner 10 and fine magnetic metal particles having the surface covered with an organic layer, is stirred at an angular frequency of 30 rad/s for 60 minutes.

Example 1

100 thousands of sheets of an image are continuously formed with modified tandem-type C2220 manufactured by Fuji Xerox Co., Ltd. adopting the trickle developing system using a toner cartridge with a supplementary developer 1 filled therein as a toner and a starting developer 1, and the electrifiability, the developability, the transferability and the fixability at an early stage and after formation of 100 thousands of sheets are assessed.

Note that, the modified C2220 used in assessment has the construction that it contains at least two or more developing units provided with at least a latent image-carrier, an electrifying means for electrifying the surface of the latent image-carrier, latent image forming means for forming a latent image on the surface of the electrified latent image-carrier, and a developing device for storing an electrostatic image developer containing a toner and a carrier, wherein the developing device develops the latent image formed on the surface of the latent image-carrier with the electrostatic image developer, so as to form a toner image, and a toner image overlaying means for successively overlaying a toner image, which is formed by each of the two or more developing units, onto a transfer receiving material, and all of the two or more developing units are provided with at least a toner cartridge for appropriately supplying a supplementary developer containing a toner and a carrier to a developing device, and developer collecting means for collecting excess electrostatic image developer that appears in the developing device due to the supplying of the supplementary developer.

Note that, this image forming apparatus has developer supplying means composed of a toner cartridge, and is modified so that a starting developer and the toner cartridge can be exchanged every test, a process speed can be regulated at a desired value, and can be compulsorily stopped and, thereupon, a toner can be sampled from the surface a latent image-carrier and the surface of an intermediate transferring material as described later.

As a result, at an early stage of image formation, the electrifiability of a toner is better, the developability is also better, and a clear image having neither fog nor scattering is achieved. In addition, the image is sufficiently fixed, and peeling at fixation is smooth.

In addition, the same result as that at an early stage is obtained even after formation of 100 thousands of sheets of an image, and deterioration with time in the electrifiability, the developability, the transferability and the fixability does not occur. The results are shown in Table 1.

Example 2

According to the same manner as that of Example 1 except that a toner cartridge with a supplementary developer 2 filled therein as a toner and a starting developer 2 are used, assessment is performed.

As a result, at an early stage of image formation, the electrifiability of a toner is better, the developability is also better, and a clear image having neither fog nor scattering is achieved. In addition, the image is sufficiently fixed, and peeling at fixation is smooth.

In addition, the same result as that at an early stage is obtained even after formation of 100 thousands of sheets of an image, and deterioration with time in the electrifiability, the developability, the transferability and the fixability did not occur. The results are shown in Table 1.

Example 3

According to the same manner as that of Example 1 except that a toner cartridge with a supplementary developer 3 filled therein as a toner and a starting developer 3 are used, assessment is performed.

As a result, at an early stage of image formation, the electrifiability of a toner is better, the developability is also better, and a clear image having neither fog nor scattering is achieved. In addition, the image is sufficiently fixed, and peeling at fixation is smooth.

In addition, the same result as that at an early stage is obtained even after formation of 100 thousands of sheets of an image, and deterioration with time in the electrifiability, the developability, the transferability and the fixability does not occur. The results are shown in Table 1.

Example 4

According to the same manner as that of Example 1 except that a toner cartridge with a supplementary developer 4 filled therein as a toner and a starting developer 4 are used, assessment is performed.

As a result, at an early stage of image formation, the electrifiability of a toner is better, the developability is also better, and a clear image having neither fog nor scattering is achieved. In addition, the image is sufficiently fixed, and peeling at fixation is smooth.

In addition, the same result as that at an early stage is obtained even after formation of 100 thousands of sheets of an image, and deterioration with time in the electrifiability, the developability, the transferability and the fixability does not occur. The results are shown in Table 1.

Example 5

According to the same manner as that of Example 1 except that a toner cartridge with a supplementary developer 5 filled therein as a toner and a starting developer 5 are used, assessment is performed.

As a result, at an early stage of image formation, the electrifiability of a toner is better, the developability is also better, and a clear image having neither fog nor scattering is achieved. In addition, the image is sufficiently fixed, and peeling at fixation is smooth.

In addition, the same result as that at an early stage is obtained even after formation of 100 thousands of sheets of an image, and deterioration with time in the electrifiability, the developability, the transferability and the fixability does not occur. The results are shown in Table 1.

Example 6

According to the same manner as that of Example 1 except that a toner cartridge with a supplementary developer 6 filled therein as a toner and a starting developer 6 are used, assessment is performed.

As a result, at an early stage of image formation, the electrifiability of a toner is better, the developability is also better, and a clear image having neither fog nor scattering is achieved. In addition, the image is sufficiently fixed, and peeling at fixation is smooth.

In addition, the same result as that at an early stage is obtained even after formation of 100 thousands of sheets of an image, and deterioration with time in the electrifiability, the developability, the transferability and the fixability does not occur. The results are shown in Table 1.

Example 7

According to the same manner as that of Example 1 except that a toner cartridge with a supplementary developer 7 filled therein as a toner and a starting developer 7 are used, assessment is performed.

As a result, at an early stage of image formation, the electrifiability of a toner is better, the developability is also better, and a clear image having neither fog nor scattering is achieved. In addition, the image is sufficiently fixed, and peeling at fixation is smooth.

In addition, the same result as that at an early stage is obtained even after formation of 100 thousands of sheets of an image, and deterioration with time in the electrifiability, the developability, the transferability and the fixability does not occur. The results are shown in Table 1.

Example 8

According to the same manner as that of Example 1 except that a toner cartridge with a supplementary developer 8 filled therein as a toner and a starting developer 8 are used, assessment is performed.

As a result, at an early stage of image formation, the electrifiability of a toner is better, the developability is also better, and a clear image having neither fog nor scattering is achieved. In addition, the image is sufficiently fixed, and peeling at fixation is smooth.

In addition, the same result as that at an early stage is obtained even after formation of 100 thousands of sheets of an image, and deterioration with time in the electrifiability, the developability, the transferability and the fixability does not occur. The results are shown in Table 1.

Comparative Example 1

According to the same manner as that of Example 1 except that a toner cartridge with a supplementary developer 9 filled therein as a toner and a starting developer 9 are used, assessment is performed.

As a result, the electrifiability of a toner is low from early stage of image formation, and reduction in the developability, fog and scattering occur. In addition, fixation of an image is insufficient. The results are shown in Table 1.

Comparative Example 2

According to the same manner as that of Example 1 except that a toner cartridge with a supplementary developer 10 filled therein as a toner and a starting developer 10 are used, assessment is performed.

As a result, the electrifiability of a toner is better at an early stage of image formation, the developability is also better and an image having little fog and scattering is achieved. In addition, an image is fixed, and peeling at fixation is possible. However, after copying of many sheets, all are deteriorated. The results are shown in Table 1.

Comparative Example 3

According to the same manner as that of Example 1 except that a toner cartridge with a supplementary developer 9 filled therein as a toner and a starting developer 1 are used, assessment is performed.

As a result, the electrifiability of a toner is better at an early stage of image formation, the developability is also better and an image having little fog and scattering is achieved. In addition, an image is sufficiently fixed, and peeling at fixation is smooth. However, after copying of many sheets, deterioration is observed. The results are shown in Table 1.

Comparative Example 4

According to the same manner as that of Example 1 except that a toner cartridge with a supplementary developer 10 filled therein as a toner and a starting developer 1 are used, assessment is performed.

As a result, the electrifiability of a toner is better at an early stage of image formation, the developability is also better and an image having little fog and scattering is achieved. In addition, an image is sufficiently fixed, and peeling at fixation is smooth. However, after copying of many sheets, deterioration is observed. The results are shown in Table 1.

TABLE 1

| | | | Example 1 | Example 2 | Example 3 | Example 4 | Example 5 | Example 6 | Example 7 | Example 8 |
|---|---|---|---|---|---|---|---|---|---|---|
| Starting developer | | | 1 | 2 | 3 | 4 | 5 | 6 | 7 | 8 |
| Supplementary developer | | | 1 | 2 | 3 | 4 | 5 | 6 | 7 | 8 |
| Fine inorganic particle-adhered toner | | | 1 | 2 | 3 | 4 | 5 | 6 | 7 | 8 |
| Properties of toner | Average circularity | | 0.965 | 0.972 | 0.959 | 0.968 | 0.951 | 0.967 | 0.980 | 0.940 |
| | A ratio of the number of particles having an average circularity of 0.970 or greater, in a particle diameter range of a toner circle-equivalent diameter × 3/5 or less (%) | | 1.9 | 3.6 | 1.1 | 4.8 | 4.0 | 2.4 | 5.0 | 1.1 |
| | A ratio of the number of particles having an average circularity of 0.950 or less, in a particle diameter range of a toner circle-equivalent diameter × 7/5 or greater (%) | | 4.7 | 1.2 | 9.0 | 5.7 | 2.2 | 4.0 | 1.5 | 9.5 |
| | Circle-equivalent diameter (μm) | | 6.0 | 6.1 | 6.2 | 3.7 | 6.3 | 9.7 | 3.0 | 10.1 |
| | D50(v)(μm) | | 5.9 | 6.0 | 6.1 | 3.7 | 6.2 | 9.6 | 3.0 | 10.0 |
| | GSD(v) | | 1.19 | 1.20 | 1.22 | 1.22 | 1.24 | 1.21 | 1.19 | 1.25 |
| | GSD(p) | | 1.21 | 1.23 | 1.20 | 1.23 | 1.24 | 1.22 | 1.25 | 1.20 |
| | GSD(punder) | | 1.23 | 1.25 | 1.22 | 1.26 | 1.26 | 1.24 | 1.27 | 1.22 |
| | Compression ratio G1 | | 0.32 | 0.34 | 0.41 | 0.36 | 0.32 | 0.28 | 0.38 | 0.45 |
| | Compression ratio G1/G2 | | 0.65 | 0.74 | 0.77 | 0.84 | 0.80 | 0.59 | 0.63 | 0.86 |
| | Dielectric constant | | 1.5 | 1.0 | 1.9 | 1.6 | 1.9 | 2.6 | 1.0 | 2.7 |
| | Dielectric loss tangent tan δ | | 0.006 | 0.004 | 0.018 | 0.010 | 0.017 | 0.007 | 0.002 | 0.018 |
| Assessment | Early stage | Electrification amount (CSG method) | ○ | ○ | ○ | ○ | ○ | ○ | ○ | ○ |
| | | Image concentration | ○ | ○ | ○ | ○ | ○ | ○ | ○ | ○ |
| | | Fog on latent image carrier | ○ | ○ | ○ | ○ | ○ | ○ | ○ | ○ |
| | | Fixability | ○ | ○ | ○ | ○ | ○ | ○ | ○ | ○ |
| | | Tansfer efficacy | ○ | ○ | ○ | ○ | ○ | ○ | ○ | ○ |

TABLE 1-continued

| | | | | | | | | | |
|---|---|---|---|---|---|---|---|---|---|
| 100 thousands | Electrification amount (CSG method) | ○ | ○ | ○ | ○ | ○ | ○ | ○ | ○ |
| | Image concentration | ○ | ○ | ○ | ○ | ○ | ○ | ○ | ○ |
| | Fog on latent image carrier | ○ | ○ | ○ | ○ | ○ | ○ | ○ | ○ |
| | Fixability | ○ | ○ | ○ | ○ | ○ | ○ | ○ | ○ |

| | | | Comparative Example 1 | Comparative Example 2 | Comparative Example 3 | | Comparative Example 4 | |
|---|---|---|---|---|---|---|---|---|
| Starting developer | | | 9 | 10 | 1 | | 1 | |
| Supplementary developer | | | 9 | 10 | | 9 | | 10 |
| Fine inorganic particle-adhered toner | | | 9 | 10 | 1 | 9 | 1 | 10 |
| Properties of toner | Average circularity | | 0.991 | 0.932 | 0.965 | 0.991 | 0.965 | 0.932 |
| | A ratio of the number of particles having an average circularity of 0.970 or greater, in a particle diameter range of a toner circle-equivalent diameter × 3/5 or less (%) | | 15.0 | 0.86 | 1.9 | 15.0 | 1.9 | 0.86 |
| | A ratio of the number of particles having an average circularity of 0.950 or less, in a particle diameter range of a toner circle-equivalent diameter × 7/5 or greater (%) | | 3.4 | 15.0 | 4.7 | 3.4 | 4.7 | 15.0 |
| | Circle-equivalent diameter (μm) | | 2.7 | 12.2 | 6.0 | 2.7 | 6.0 | 12.2 |
| | D50(v)(μm) | | 2.7 | 12.0 | 5.9 | 2.7 | 5.9 | 12.0 |
| | GSD(v) | | 1.31 | 1.35 | 1.19 | 1.31 | 1.19 | 1.35 |
| | GSD(p) | | 1.33 | 1.27 | 1.21 | 1.33 | 1.21 | 1.27 |
| | GSD(punder) | | 1.36 | 1.31 | 1.23 | 1.36 | 1.23 | 1.31 |
| | Compression ratio G1 | | 0.23 | 0.31 | 0.32 | 0.23 | 0.32 | 0.31 |
| | Compression ratio G1/G2 | | 0.41 | 0.67 | 0.65 | 0.41 | 0.65 | 0.67 |
| | Dielectric constant | | 3.2 | 0.9 | 1.5 | 3.2 | 1.5 | 0.9 |
| | Dielectric loss tangent tan δ | | 0.056 | 0.001 | 0.006 | 0.056 | 0.006 | 0.001 |
| Assessment | Early stage | Electrification amount (CSG method) | x | Δ | ○ | | ○ | |
| | | Image concentration | x | Δ | ○ | | ○ | |
| | | Fog on latent image carrier | x | Δ | ○ | | ○ | |
| | | Fixability | x | Δ | ○ | | ○ | |
| | | Tansfer efficacy | x | x | x | | x | |
| | 100 thousands | Electrification amount (CSG method) | x | x | x | | x | |
| | | Image concentration | x | x | x | | x | |
| | | Fog on latent image carrier | x | x | x | | x | |
| | | Fixability | x | x | x | | x | |

Assessment of the electrifiability, the developability, the transferability and the fixability shown in Table 1 is performed according to the following criteria.

Assessment of Electrifiability and its Assessment Criteria

The electrifiability is assessed by collecting a small amount of a developer from a developing device, and measuring a frequency distribution of a q/d value of the developer by a charge spectrographic method (hereinafter, referred to as "CSG method"), wherein q (fC) represents an electrification amount of a toner, and d (μm) represents a volume average particle diameter of a toner. The CSG method used in measurement is according to a measuring method described in U.S. Pat. No. 4,375,673 specification. Assessment criteria are as follows:

○: A distribution is sharp, and there is no toner particle having the reverse polarity.

Δ: A distribution is broad, and there is no toner particle having the reverse polarity.

X: A distribution is broad, and a toner particle having the reverse polarity occurs.

Assessment of Developability and its Assessment Criteria

Assessment of the developability is performed by judging the concentration of an image and fog after copying with naked eyes. Assessment criteria are as follows:

○: The image concentration is reduced, and fog is not observed.

Δ: The image concentration is reduced, and slight fog is observed.

X: The image concentration is reduced, and fog is remarkable.

Assessment of Transferability and its Assessment Criteria

Assessment of the Transferability is Performed as Follows. Stopping an image forming apparatus under the environment of a temperature of 30° C. and a humidity of 90% RH at completion of a transferring step, a toner at two places having a certain area on the surface of a photosensitive member (latent image-carrier) is transferred on an adhesive tape. Then, a mass of a toner-adhered tape is measured. Here, an amount (a) of a transferred toner is obtained by averaging of the value which pulled the mass of the toner-adhered tape to a mass of the adhesive tape, and an amount (b) of a toner remaining on the surface of the photosensitive member is obtained like the case where amount (a) is obtained. Finally, a transfer efficacy is calculated according to the following equation (1):

$$\text{Transfer efficacy } \eta(\%)=[a/(a+b)]\times 100 \qquad \text{Equation (1)}$$

A target transfer efficacy is 90% or greater, and a transfer efficacy is assessed by the following criteria:

○: $\eta \geqq 80\%$

X: $\eta < 80\%$

Note that, for assessing the transferability, a process black color by which four colors are expressed by overlaying, is selected. Thereupon, a developed amount on the surface of a photosensitive member is in the range of 160 to 200 g/m$^2$.

Assessment of Fixability and its Assessment Criteria

The fixability is assessed by folding a paper with an image after fixation, and measuring a deleted width of a folding line of the image. For assessment, a process black color by which four colors are expressed by overlaying, is selected. Thereupon, a test is performed so that a developed amount of the surface of a photosensitive member is in the range of 160 to 200 g/m$^2$. Assessment criteria are as follows:

○: No deletion

Δ: Slight deletion

X: Occurrence of deletion

As described above, according to the invention, there can be provided an image forming method, an image forming apparatus and a toner cartridge in which deterioration with time in the electrifiability, the developability, the transferability and the fixability is hardly caused and, even when image formation is performed over a longer period of time, an image of the high quality can be formed stably, in tandem-type image formation having two or more image formation processes, and utilizing the so-called trickle development of performing image formation while supplying a developer to a developing device used in at least one image formation process, and collecting an excessive developer in the developing device.

What is claimed is:

1. An image forming method, which comprises:

two or more toner image forming processes comprising at least electrifying the surface of a latent image-carrier;

forming a latent image on the surface of the electrified latent image-carrier; and forming a toner image by developing the latent image formed on the surface of the latent image-carrier with an electrostatic image developer, which is stored in a developing device and contains a toner and a carrier, wherein in at least one of the two or more toner image forming processes, the development is performed while appropriately supplying a supplementary developer containing a toner and a carrier to a developing device, and collecting excess electrostatic image developer that appears in the developing device due to the supplying of the supplementary developer, and an image is formed on a transfer receiving material by overlaying a toner image, the overlaying comprising successively overlaying a toner image formed by each of the two or more toner image forming processes, and a circularity of toner particles contained in at least the supplementary developer is in the range of 0.940 to 0.980; a first ratio is 5% or less, wherein the first ratio is a ratio of a number of particles having a circularity of 0.970 or greater among particles having a diameter less than or equal to 3/5 of a specific circle-equivalent diameter to a total number of particles having a diameter less than or equal to 3/5 of the specific circle-equivalent diameter; and a second ratio is 10% or less, wherein the second ratio is a ratio of a number of particles having a circularity of 0.950 or less among particles having a diameter greater than or equal to 7/5 of the specific circle-equivalent diameter to a total number of particles having a diameter greater than or equal to 7/5 of the specific circle-equivalent diameter.

2. An image forming method according to claim 1, wherein an unused developer is stored in the developing device, and a circularity of toner particles contained in the unused developer is in the range of 0.940 to 0.980; a first ratio is 5% or less, wherein the first ratio is a ratio of a number of particles having a circularity of 0.970 or greater among particles having a diameter less than or equal to 3/5 of specific circle-equivalent diameter to a total number of particles having a diameter less than or equal to 3/5 of the specific circle-equivalent diameter; and a second ratio is 10% or less, wherein the second ratio is a ratio or a number of particles having a circularity of 0.95 0 or less among particles having a diameter greater than or equal to 7/5 of the specific circle-equivalent diameter to a total number of particles having a diameter greater than or equal to 7/5 of the specific circle-equivalent diameter.

3. An image forming method according to claim 1, wherein a volume average particle diameter of a toner contained in the supplementary developer is in the range of 3 to 10 μm; a volume average particle size distribution index GSD (v) is 1.25 or less; a number average particle size distribution index GSD (p) is 1.25 or less; and a lower side number average particle diameter distribution index GSD (punder) is 1.27 or less.

4. An image forming method according to claim 1, wherein at least fine inorganic particles are added to the surface of the toner contained in the supplementary developer; a flowability index (compression ratio) G1 of the toner having fine inorganic particles added to the surface thereof is in the range of 0.32 to 0.45; and a ratio of the flowability index (compression ratio) G1 relative to a flowability index (compression ratio) G2 (G1/G2) after the toner having fine inorganic particles is mixed with fine magnetic metal particles, the surfaces of which are covered with an organic layer, and the mixture is stirred at an angular frequency of 30 rad/s or more for 60 minutes, is 0.63 or more.

5. An image forming method according to claim 1, wherein a dielectric constant ε' of a toner contained in the supplementary developer is in the range of 1.0 to 2.7, and a dielectric loss tangent tan d of the toner is in the range of 0.002 to 0.018.

6. An image forming method according to claim 1, wherein the toner contained in at least the supplementary developer contains a releasing agent, and an exposure rate of the releasing agent on the toner surface quantified by X-ray photoelectron spectrometry (XPS) is in the range of 11 to 40 atm %.

7. An image forming method according to claim 1, wherein image formation is performed at a constant process speed, which is switchable.

8. An image forming method according to claim 1, wherein the electrifying step is performed using a roll electrifying type electrifying equipment.

9. An image forming method according to claim 1, comprising a cleaning step for cleaning the surface of the latent image-carrier.

10. An image forming method according to claim 1, wherein the toner contained in the supplementary developer is produced by a wet process.

11. An image forming method according to claim 10, wherein the wet process comprises:

a first aggregating step of adding an aggregating agent to a mixture, which is obtained by mixing a first resin fine particle dispersion, in which first resin fine particles having an average particle diameter of 1 mm or less are dispersed, a colorant dispersion, a releasing agent dispersion, and a dispersion in which fine inorganic particles are dispersed, so as to form core aggregated particles in the mixture;

a second aggregating step of forming a surface layer containing second resin fine particles on the surface of the core aggregated particles using a second resin fine particle dispersion in which the second resin fine particles are dispersed, to prepare core/shell-type aggregated particles; and a fusing and coalescing step of fusing and coalescing the core/shell-type aggregated particles by heating the core/shell-type aggregated particles to a temperature higher than the glass transition temperatures of the first resin fine particles and the second resin fine particles.

12. An image forming method according to claim 10, wherein the aggregating agent comprises at least an aluminum compound containing aluminum ions, and the amount of the aluminum compound to be added relative to the total weight of toner-constituting solid matter contained in the mixture is in the range of 0.1 to 2.7% by weight.

13. An image forming method according to claim 1, wherein in all of the two or more toner image forming processes, the developing step of each toner image forming process is performed while appropriately supplying a supplementary developer containing a toner and a carrier to a developing device, and collecting excess electrostatic image developer that appears in the developing device due to the supplying of the supplementary developer.

14. An image forming apparatus which comprises at least:

two or more developing units provided with at least a latent image-carrier, an electrifying means for electrifying the surface of the latent image-carrier, latent image forming means for forming a latent image on the surface of the electrified latent image-carrier, and a developing device for storing an electrostatic image developer containing a toner and a carrier, wherein the developing device develops the latent image formed on the surface of the latent image-carrier with the electrostatic image developer, so as to form a toner image; and a toner image overlaying means for successively overlaying a toner image, which is formed by each of the two or more developing units, onto a transfer receiving material, wherein at least one of the two or more developing units is provided with at least a developer supplying means for appropriately supplying a supplementary developer containing a toner and a carrier to a developing device, and a developer collecting means for collecting excess electrostatic image developer that appears in the developing device due to the supplying of the supplementary developer, and a circularity of particles contained in at least the supplementary developer is in the range of 0.940 to 0.980; a first ratio is 5% or less, wherein the first ratio is a ratio of a number of particles having a circularity of 0.970 or greater among particles having a diameter less than or equal to 3/5 of a specific circle-equivalent diameter to a total number of particles having a diameter less than or equal to 3/5 of the specific circle-equivalent diameter; and a second ratio is 10% or less, wherein the second ratio is a ratio of a number particles having a circularity of 0.950 or less among particles having a diameter greater than or equal to 7/5 of the specific circle-equivalent diameter to a total number of particles having a diameter greater than or equal to 7/5 of the specific circle-equivalent diameter.

15. An image forming apparatus according to claim 14, wherein all of the two or more developing units are provided with the developer collecting means.

16. An image forming apparatus according to claim 14, wherein an unused developer is stored in the developing device in the two or more developing units;

a circularity of toner particles contained in the unused developer is in the range of 0.940 to 0.980; a first ratio is 5% or less, wherein the first ratio is a ratio of a number of particles having a circularity of 0.970 or greater among particles having a diameter less than or equal to 3/5 of the specific circle-equivalent diameter to a total number of particles having a diameter less than or equal to 3/5 of the specific circle-equivalent diameter; and a second ratio is 10% or less, wherein the second ratio is a ratio of a number of particles a circularity of 0.950 or less of among particles having a diameter greater than or equal to 7/5 of the specific circle-equivalent diameter to a total number of particles having a diameter greater than or equal to 7/5 of the specific toner circle-equivalent diameter.

17. A toner cartridge that is detachable from an image forming apparatus and which stores a supplementary developer containing a toner in which a circularity of toner particles is in the range of 0.940 to 0.980; a first ratio is 5% or less, wherein the first ratio is a ratio of a number of particles having a circularity of 0.970 or greater among particles having a diameter less than or equal to 3/5 of a specific circle-equivalent diameter to a total number of particles having a diameter less than or equal to 3/5 of the specific circle-equivalent diameter; and a second ratio is 10% or less, wherein the second ratio is a ratio of a number of particles having a circularity of 0.950 or less among particles having a diameter greater than or equal to 7/5 of the specific circle-equivalent diameter to a total number of particles having a diameter greater than or equal to 7/5 of the specific circle-equivalent diameter.

18. A toner cartridge used in an image forming apparatus, comprising at least:

two or more developing units provided with at least a latent image-carrier, an electrifying means for electrifying the surface of the latent image-carrier, latent image forming means for forming a latent image on the surface of the electrified latent image-carrier, and a developing device for storing an electrostatic image developer containing a toner and a carrier, wherein the developing device develops the latent image formed on the surface of the latent image-carrier with the electrostatic image developer, so as to form a toner image; and a toner image overlaying means for successively overlaying a toner image, which is formed by each of the two or more developing units, onto a transfer receiving material, wherein at least one of the two or more developing units is provided with at least a toner cartridge for storing a supplementary developer containing a toner and a carrier, and appropriately supplying the supplementary developer to a developing device; and a developer collecting means for collecting excess electrostatic image developer that appears in the developing device due to the supplying of the supplementary developer, and a circularity of toner particles contained in a supplementary developer stored in the toner cartridge is in the range of 0.940 to 0.980; a first ratio is 5% or less, wherein the first ratio is a ratio of a number of particles having a circularity of 0.970 or greater among particles having a diameter less than or equal to 3/5 of a specific circle-equivalent diameter to a total number of particles having a diameter less than or equal to 3/5 of the specific circle-equivalent diameter; and a second ratio is 10% or less, wherein the second ratio is a ratio of a number of particles having a circularity of 0.950 or less among particles having a diameter greater than or equal to 7/5 of the specific circle-equivalent diameter to a total number of particles having a diameter greater than or equal to 7/5 of the specific circle-equivalent diameter.

* * * * *